US011691420B2

(12) United States Patent
Kanzaki et al.

(10) Patent No.: US 11,691,420 B2
(45) Date of Patent: Jul. 4, 2023

(54) LIQUID DISCHARGE HEAD

(71) Applicant: Brother Kogyo Kabushiki Kaisha, Nagoya (JP)

(72) Inventors: Shotaro Kanzaki, Handa (JP); Keita Sugiura, Toyokawa (JP); Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 246 days.

(21) Appl. No.: 17/331,879

(22) Filed: May 27, 2021

(65) Prior Publication Data

US 2021/0402768 A1 Dec. 30, 2021

(30) Foreign Application Priority Data

Jun. 29, 2020 (JP) ..... 2020-111496

(51) Int. Cl.
*B41J 2/14* (2006.01)
*B05B 1/14* (2006.01)

(52) U.S. Cl.
CPC ..... *B41J 2/1433* (2013.01); *B05B 1/14* (2013.01); *B41J 2002/14338* (2013.01); *B41J 2002/14467* (2013.01); *B41J 2002/14475* (2013.01)

(58) Field of Classification Search
CPC ..... B41J 2/1433; B41J 2002/14338; B41J 2002/14467; B41J 2002/14475; B05B 1/14; B05B 17/0607
USPC .... 239/102.2, 548, 566, 568; 347/40, 54, 68
See application file for complete search history.

(56) References Cited

U.S. PATENT DOCUMENTS 7,712,679 B2 * 5/2010 Onozawa ..... B41J 2/215 239/102.2
7,988,068 B2 * 8/2011 Mita ..... B41J 2/0454 239/102.2
8,205,978 B2 6/2012 Shimizu
8,672,463 B2 3/2014 Essen et al.
2006/0221125 A1 * 10/2006 Konno ..... B41J 2/1433 347/40
2007/0115323 A1 * 5/2007 Mori ..... B41J 2/1433 347/40
2010/0073446 A1 3/2010 Shimizu
2011/0115852 A1 5/2011 Bibl et al.
2011/0148988 A1 6/2011 Hoisington et al.
(Continued)

FOREIGN PATENT DOCUMENTS

JP 2010-076175 A 4/2010
JP 2011-520671 A 7/2011
(Continued)

OTHER PUBLICATIONS

May 27, 2021—(US) Co-pending U.S. Appl. No. 17/331,833.
May 27, 2021—(US) Co-pending U.S. Appl. No. 17/331,923.

*Primary Examiner* — Steven J Ganey
(74) *Attorney, Agent, or Firm* — Banner & Witcoff, Ltd.

(57) ABSTRACT

There is provided a liquid discharge head, including: a nozzle member formed having nozzle rows extending in a first direction, the nozzle rows being arranged in a second direction; driving elements; a first channel member disposed at one side of the nozzle member in a third direction; a second channel member disposed at the one side of the first channel member in the third direction; and a third channel member disposed at the one side of the second channel member in the third direction.

14 Claims, 19 Drawing Sheets

(56) References Cited

U.S. PATENT DOCUMENTS

| | | | | |
|---|---|---|---|---|
| 2013/0293641 | A1 | 11/2013 | Essen et al. | |
| 2019/0001682 | A1 * | 1/2019 | Sonobata | B41J 2/14209 |

FOREIGN PATENT DOCUMENTS

| | | | |
|---|---|---|---|
| JP | 2013-230677 | A | 11/2013 |
| JP | 2014-065313 | A | 4/2014 |

* cited by examiner

LIQUID DISCHARGE HEAD

CROSS REFERENCE TO RELATED APPLICATION

The present application claims priority from Japanese Patent Application No. 2020-111496 filed on Jun. 29, 2020, the disclosure of which is incorporated herein by reference in its entirety.

BACKGROUND

Field of the Invention

The present disclosure relates to a liquid discharge head configured to discharge liquid from nozzles.

Description of the Related Art

As a liquid discharge head that discharges liquid from nozzles, there is publicly known a print head module that discharges fluid from nozzles. A publicly-known print head module includes a fluid distribution structure in which an interposer layer is disposed between a die formed having channels that include nozzles and a manifold formed having a fluid supply chamber, a fluid recovery chamber, and the like. The interposer layer is formed having a supply channel through which fluid inflows from the fluid supply chamber and then is distributed to channels of the die and a recovery channel through which fluid not discharged from the nozzles in the channels of the die circulates to or returns to the fluid recovery chamber. Further, there is known that the die may be provided with an actuator controlled by an integrated circuit wafer and that the actuator and an integrated circuit may generate heat that is dispersed or dissipated over the whole of the die. In the publicly-known print head module, the interposer layer is formed having a bypass channel that connects the fluid supply chamber and the fluid recovery chamber.

SUMMARY

In the publicly-known print head module, the interposer layer is formed having the bypass channel. This allows air bubbles and foreign matters in the fluid supply chamber to flow to the fluid recovery chamber via the bypass channel. Thus, air bubbles and foreign matters are discharged from the fluid recovery chamber to the outside without flowing into the above channels. However, in the publicly-known print head module, the interposer layer is a thin member. Thus, a cross-sectional area of a cross-section orthogonal to a direction in which fluid flows through the bypass channel is small. This makes a channel resistance of the bypass channel large, and makes a flow rate (flow amount) of fluid flowing from the fluid supply chamber to the fluid recovery chamber via the bypass channel small. Further, in the publicly-known print head module, heat is generated in the actuator and the integrated circuit at the time of driving the actuator. When the flow rate (flow amount) of fluid flowing from the fluid supply chamber to the fluid recovery chamber via the bypass channel is small, the heat generated is not transmitted uniformly to the whole of the print head module, causing variation in temperatures between parts or components of the print head module.

An object of the present disclosure is to provide a liquid discharge head capable of uniformizing temperature.

According to an aspect of the present disclosure, there is provided a liquid discharge head, including: a nozzle member including a plurality of nozzles that form parts of a plurality of individual channels, the nozzles forming a plurality of nozzle rows that extend in a first direction, the nozzle rows being arranged in a second direction intersecting with the first direction; a plurality of driving elements corresponding to the respective individual channels, each of the driving elements configured to apply discharge energy to a liquid in a corresponding one of the individual channels; a first channel member; a second channel member; and a third channel member. The first channel member is disposed at one side of the nozzle member in a third direction orthogonal to the first direction and the second direction. The first channel member includes: a plurality of first supply channels corresponding to the respective nozzle rows, the first supply channels extending in the first direction, each of the first supply channels communicating with a corresponding one of the individual channels; and a plurality of first return channels corresponding to the respective nozzle rows, the first return channels extending in the first direction, each of the first return channels communicating with a corresponding one of the individual channels. The second channel member is disposed at the one side of the first channel member in the third direction. The second channel member includes: a plurality of second supply channels corresponding to the respective first supply channels, each of the second supply channels communicating with a corresponding one of the first supply channels; and a plurality of second return channels corresponding to the respective first return channels, each of the second return channels communicating with a corresponding one of the first return channels. The third channel member is disposed at the one side of the second channel member in the third direction. The third channel member includes: a third supply channel provided in common to the second supply channels and communicating with the second supply channels; and a third return channel provided in common to the second return channels and communicating with the second return channels. The second channel member further includes a first bypass channel connecting the third supply channel and the third return channel, and the third channel member further includes a second bypass channel connecting the third supply channel and the third return channel.

DESCRIPTION OF THE EMBODIMENTS

An embodiment of the present disclosure is explained below.

<Schematic Configuration of Printer 1>

Figure 1:
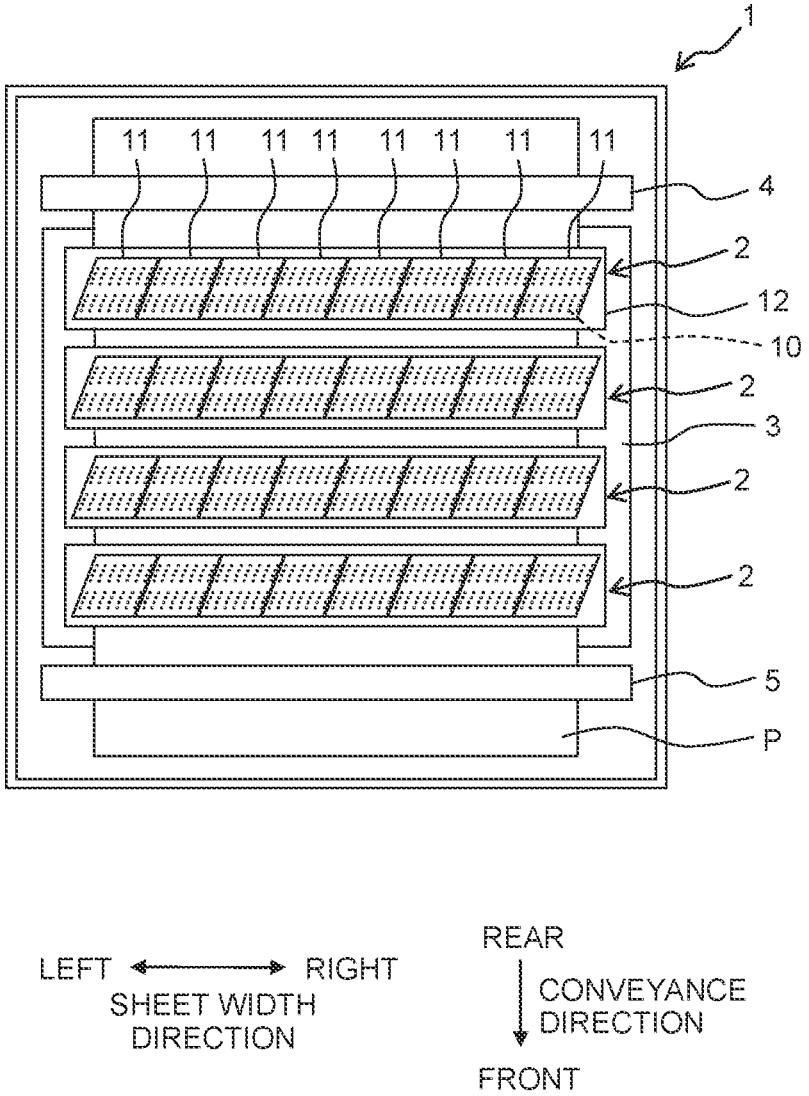
FIG. 1 depicts a schematic configuration of a primer provided with ink jet heads.

As depicted in FIG. 1, a printer 1 according to this embodiment includes four head units 2, a platen 3, and conveyance rollers 4, 5.

Each head unit 2 includes eight ink-jet heads 11 and a head holding member 12. In each ink-jet head 11, ink is discharged from nozzles 10 formed in a lower surface of the ink-jet head 11. The eight ink-jet heads 11 are arranged in a sheet width direction ("second direction" of the present disclosure) that extends horizontally.

In this configuration, the nozzles 10 of the eight ink-jet heads 11 are arranged over an entire length in the sheet width direction of a recording sheet P. That is, each head unit 2 is a so-called line head. The following explanation is made while defining the right side and the left side in the sheet width direction as indicated in FIG. 1.

The head holding member 12 is a rectangular plate-like member that extends in the sheet width direction and a conveyance direction. The conveyance direction extends horizontally and is orthogonal to the sheet width direction. The head holding member 12 holds the eight ink-jet heads 11. The following explanation is made while defining the front side and the rear side in the conveyance direction as indicated in FIG. 1.

The four head units 2 are arranged in the conveyance direction. A black ink is discharged from the nozzles 10 of a head unit 2 included in the four head units 2 and positioned at the rearmost side. A yellow ink is discharged from the nozzles 10 of a head unit 2 included in the four head units 2 and positioned at the second rearmost side. A cyan ink is discharged from the nozzles 10 of a head unit 2 included in the four head units 2 and positioned at the third rearmost side. A magenta ink is discharged from the nozzles 10 of a head unit 2 included in the four head units 2 and positioned at the frontmost side.

The platen 3 is disposed below the head units 2. The platen 3 extends over the entire length in the sheet width direction of the recording sheet P and extends over the four head units 2 in the conveyance direction. The platen 3 faces the nozzles 10 of the four head units 2 and supports the recording sheet P from below.

The conveyance roller 4 is disposed at the rear side of the four head units 2 and the platen 3. The conveyance roller 5 is disposed at the front side of the four head units 2 and the platen 3. The conveyance rollers 4 and 5 convey the recording sheet P in the conveyance direction.

In the printer 1, inks are discharged from the nozzles 10 of the eight ink-jet heads 11 of the head units 2 while the recording sheet P is conveyed in the conveyance direction by use of the conveyance rollers 4 and 5. Accordingly, recording is performed on the recording sheet P.

<Ink-Jet Head 11>

Figure 2:
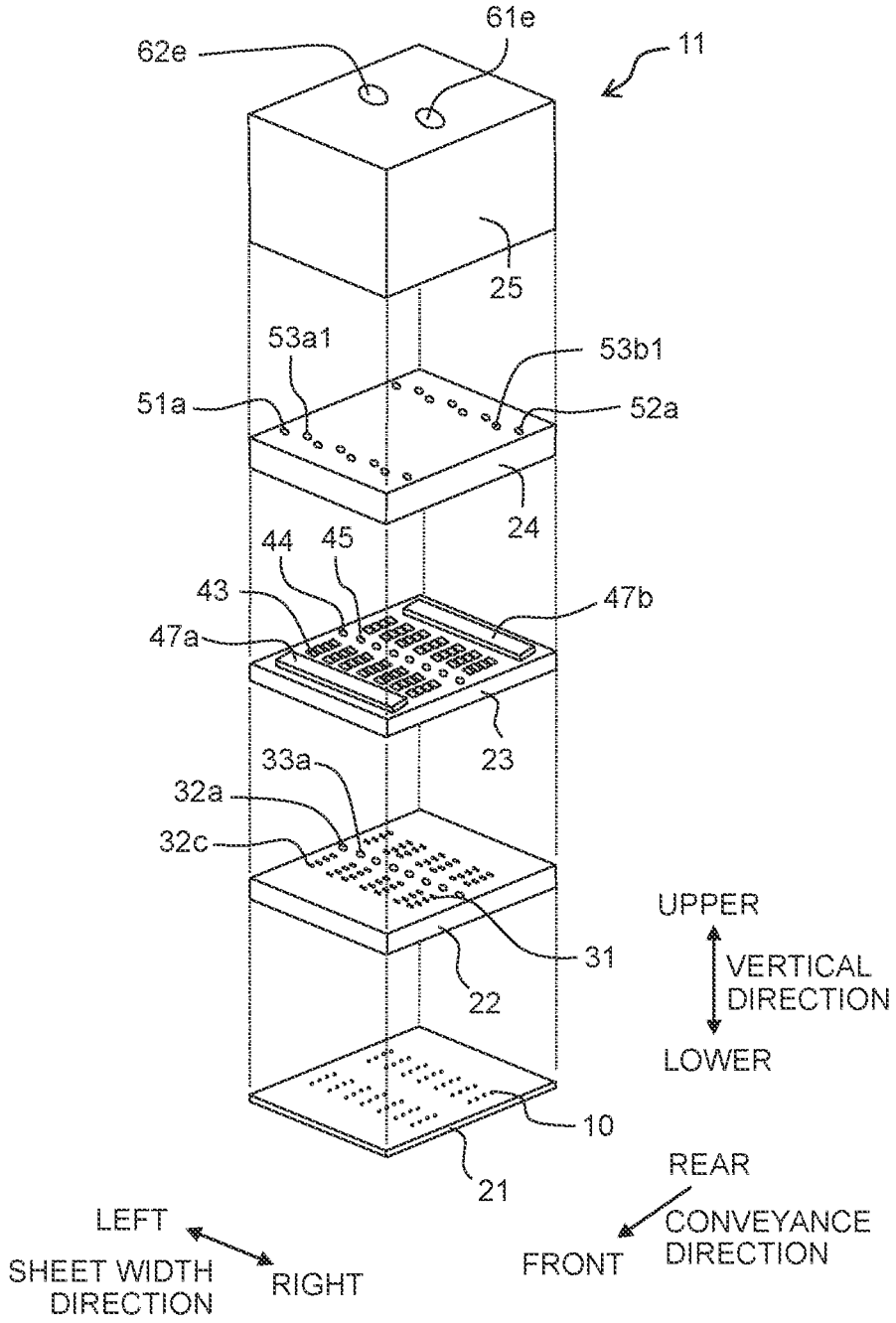
FIG. 2 is an exploded perspective view of a schematic configuration of the ink-jet head.

Subsequently, a structure of the ink-jet head 11 is explained. As depicted in FIG. 2, the ink-jet head 11 includes a nozzle member 21, a first channel member 22, an actuator member 23, a second channel member 24, and a third channel member 25. Those members are stacked in a vertical direction ("third direction" of the present disclosure) in this order from below. In this embodiment, the upper side in the vertical direction corresponds to "one side in the third direction" of the present disclosure, and the lower side in the vertical direction corresponds to "the other side in the third direction" of the present disclosure.

Figure 3:
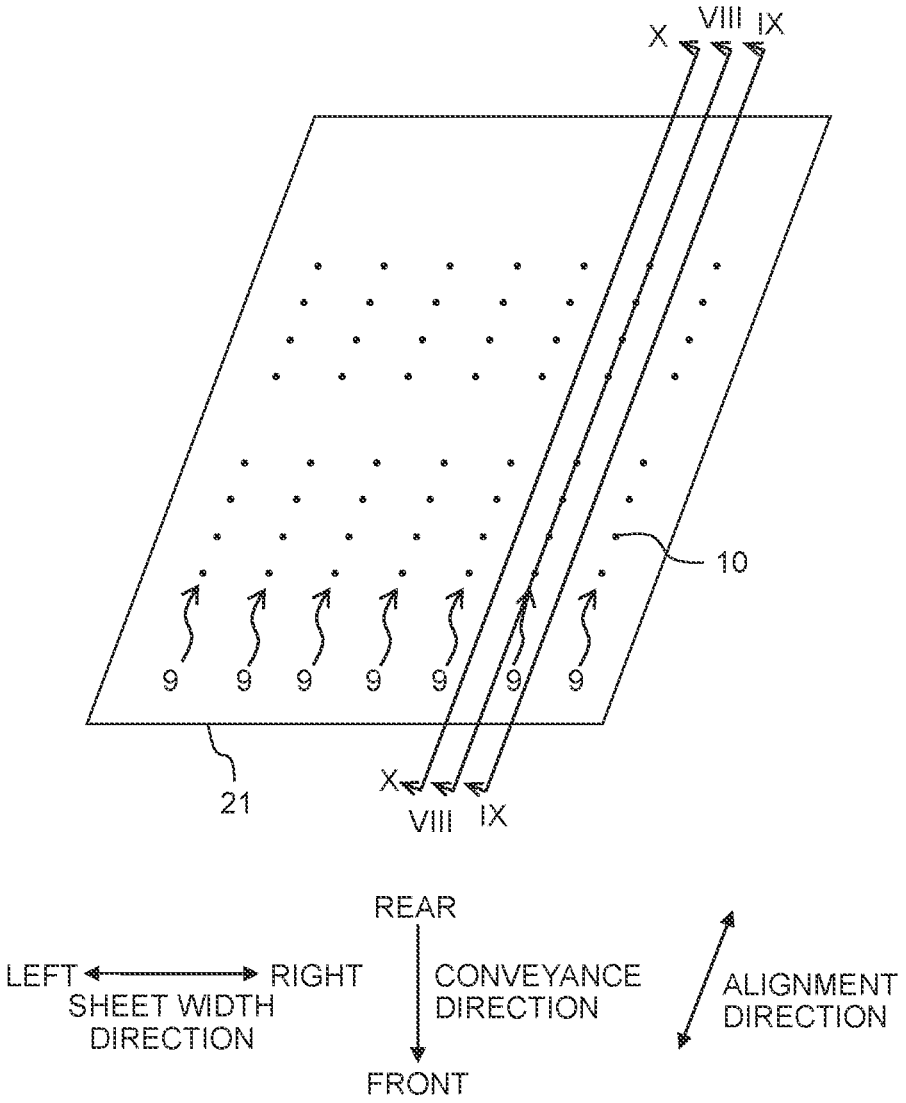
FIG. 3 is a plan view of a nozzle member.
Figure 8:
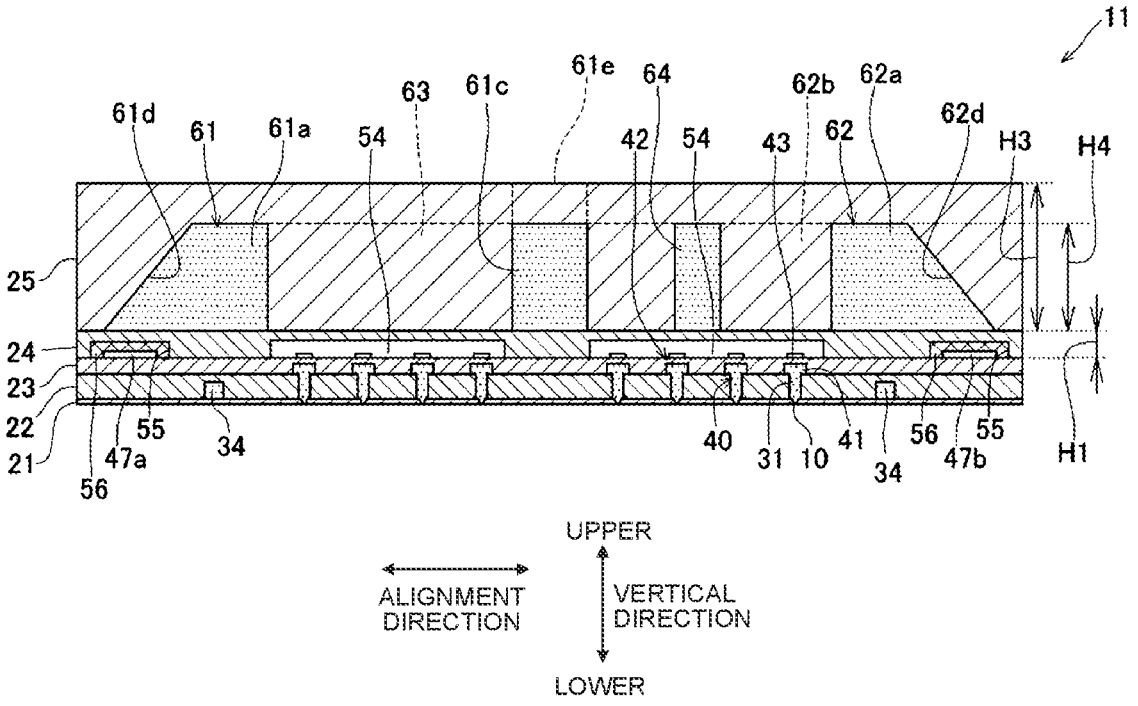
FIG. 8 is a cross-sectional view of the ink-jet head taken along a line VIII-VIII in FIGS. 3 to 7.

The nozzle member 21, which is formed from a synthetic resin material or the like, is a plate-like member. The thickness (length in the vertical direction) of the nozzle member 21 is approximately 50 to 100 μm. As depicted in FIGS. 2, 3, and 8, seven nozzle rows 9 arranged in the sheet width direction are formed in the nozzle member 21. Each nozzle row 9 includes the nozzles 10 aligned in an alignment direction ("first direction" of the present disclosure). The alignment direction extends horizontally and is inclined to the conveyance direction. In each nozzle row 9, an interval between a nozzle 10 included in the nozzles 10 forming a front-side nozzle group and positioned at the rearmost side and a nozzle 10 included in the nozzles 10 forming a rear-side nozzle group and positioned at the frontmost side is larger than an interval between any other nozzles 10 belonging to each nozzle row 9. Since the nozzles 10 formed in the nozzle member 21 are aligned as described above, the nozzles 10 are arranged at regular intervals in the sheet width direction as view in the conveyance direction.

The first channel member 22, which is formed from silicon or the like, is a plate-like member. The thickness the first channel member 22 is approximately 300 to 500 μm. The first channel member 22 is disposed on an upper surface of the nozzle member 21. As depicted in FIGS. 2, 4, and 8 to 10, the first channel member 22 includes descenders 31, four first supply channels 32, four first return channels 33, two bypass channels 34, and individual return channels 35.

Figure 4:
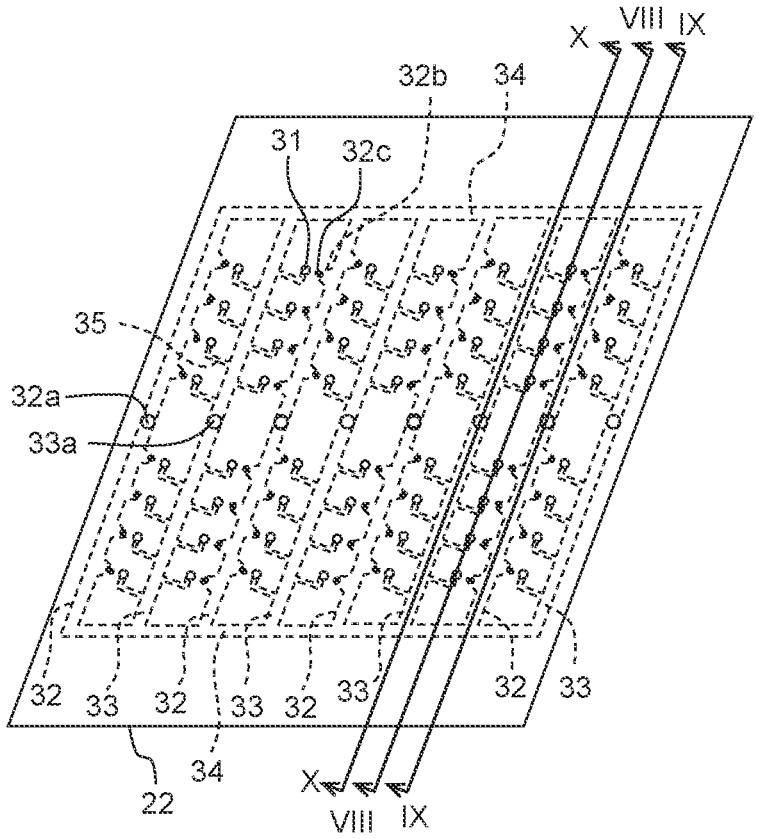
FIG. 4 is a plan view of a first channel member.
Figure 4:
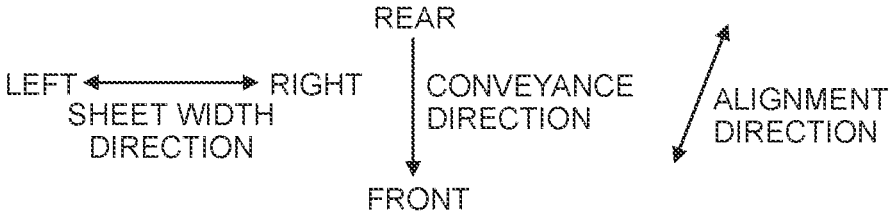

As depicted in FIG. 4, the descenders 31 are formed corresponding to the respective nozzles 10. Each of the descenders 31 overlaps in the vertical direction with the corresponding one of the nozzles 10. The descenders 31 pass through the first channel member 22 in the vertical direction.

The first supply channels 32, the first return channels 33, and the bypass channels 34 are formed by recesses opened in a lower surface of the first channel member 22.

The four first supply channels 32 extend in the alignment direction and arranged in the sheet width direction at intervals. A communication opening 32*a*, which is opened in an upper surface of the first channel member 22, is provided at a center portion in the alignment direction of each first supply channel 32.

The first supply channel 32 positioned at the leftmost side corresponds to the nozzle row 9 positioned at the leftmost side. The first supply channel 32 that is the second from the left corresponds to the second and third nozzle rows 9 from the left. The first supply channel 32 that is the third from the left corresponds to the fourth and fifth nozzle rows 9 from the left. The first supply channel 32 that is the fourth from the left corresponds to the sixth and seventh nozzle rows 9 from the left. Parts of each first supply channel 32 of which positions in the alignment direction are the same as those of the nozzles 10 forming the corresponding nozzle row(s) 9 are protrusions 32*b*. The protrusions 32*b* protrude in a direction that extends horizontally and is orthogonal to the alignment direction. The protrusions 32*b* are provided with communication openings 32*c* that are opened in the upper surface of the first channel member 22.

The four first return channels 33 extend in the alignment direction. The first return channels 33 and the first supply channels 32 are alternately arranged in the sheet width direction. A communication opening 33*a* that is opened in the upper surface of the first channel member 22 is provided at a center portion in the alignment direction of each first return channel 33.

The first return channel 33 positioned at the leftmost side corresponds to the first and second nozzle rows 9 from the left. The first return channel 33 that is the second from the left corresponds to the third and fourth nozzle rows 9 from the left. The first return channel 33 that is the third from the left corresponds to the fifth and sixth nozzle rows 9 from the left. The first return channel 33 positioned at the rightmost side corresponds to the nozzle row 9 positioned at the rightmost side.

The two bypass channels 34 extend in the sheet width direction. One of the bypass channels 34 connects front ends of the four first supply channels 32 and front ends of the four first return channels 33. The other of the bypass channels 34 connects rear ends of the four first supply channels 32 and rear ends of the four first return channels 33.

The individual return channels 35 are provided corresponding to the respective descenders 31. Each of the individual return channels 35 is connected to a lower end of the corresponding one of the descenders 31. Each individual return channel 35 extends toward the front-left side in the alignment direction from the connection portion with the descender 31, is bent in the direction that extends horizontally and is orthogonal to the alignment direction, and then is connected to the first return channel 33.

The actuator member 23, which is formed from silicon or the like, is a plate-like member. The thickness of the actuator member 23 is approximately 200 to 400 μm. The actuator member 23 is disposed on the upper surface of the first channel member 22. As depicted in FIGS. 2, 5, 8 to 10, the actuator member 23 includes pressure chambers 41, a vibration plate 42, driving elements 43, four supply communication channels 44, and four return communication channels 45.

The pressure chambers 41 correspond to the respective nozzles 10. The pressure chambers 41 are formed by recesses that are opened in a lower surface of the actuator member 23. Each pressure chamber 41 has a rectangular shape of which longitudinal direction is the direction that extends horizontally and is orthogonal to the alignment direction. A center portion in the longitudinal direction and the alignment direction of each of the pressure chambers 41 overlaps in the vertical direction with the corresponding one of the nozzles 10 and descenders 31. This allows each of the nozzles 10 to communicate with the corresponding one of the pressure chambers 41 via the descender 31.

An end at one side in the longitudinal direction of each pressure chamber 41 overlaps in the vertical direction with the communication opening 32*c*. This allows the pressure chambers 41 to communicate with the corresponding first supply channel 32 via the communication openings 32*c*. In the pressure chambers 41 corresponding to odd-numbered nozzle rows 9 from the left in the sheet width direction, the one side in the longitudinal direction of each pressure chamber 41 corresponds to the left-rear side. In the pressure chambers 41 corresponding to even-numbered nozzle rows 9 from the left in the sheet width direction, the one side in the longitudinal direction of each pressure chamber 41 corresponds to the right-front side.

In the ink-jet heads 11, each individual channel 40 is formed by the nozzle 10, the descender 31 corresponding to the nozzle 10, the individual return channel 35, and the pressure chamber 41.

As depicted in FIG. 8, the vibration plate 42 is formed by an upper end of the actuator member 23. The vibration plate 42 continuously extends over the pressure chambers 41 to cover the pressure chambers 41. The driving elements 43 correspond to the respective pressure chambers 41. The driving elements 43 are arranged at portions included in an upper surface of the vibration plate 42 and overlapping in the vertical direction with center portions of the respective pressure chambers 41. Each driving element 43 is, for example, a piezoelectric element having a piezoelectric body and an electrode. The driving element 43 deforms a part of the vibration plate 42 that overlaps in the vertical direction with the pressure chamber 41. This applies pressure to ink in the pressure chamber 41 (this applies discharge energy to ink in the individual channel 40), thereby discharging ink from the nozzle 10 that communicates with the pressure chamber 41.

Figure 5:
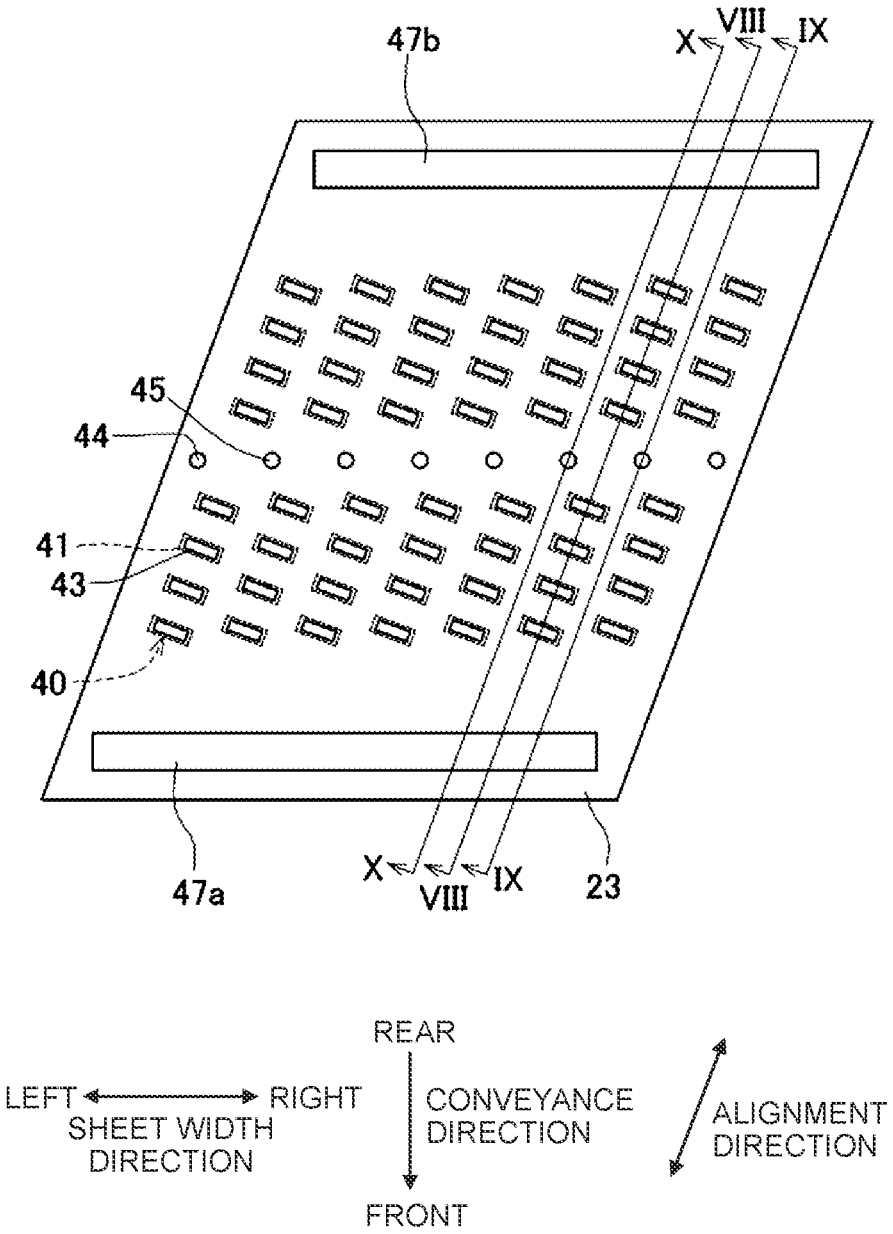
FIG. 5 is a plan view of an actuator member.

As depicted in FIG. 5, the four supply communication channels 44 correspond to the four first supply channels 32. Each of the supply communication channels 44 overlaps in the vertical direction with the communication opening 32*a* of the corresponding one of the first supply channels 32. The supply communication channels 44 pass through the actuator member 23 to extend in the vertical direction. Lower ends of the supply communication channels 44 are connected to the respective communication openings 32*a*.

The four return communication channels 45 correspond to the four first return channels 33. Each of the return communication channels 45 overlaps in the vertical direction with the communication opening 33*a* of the corresponding one of the first return channels 33. The return communication channels 45 pass through the actuator member 23 to extend in the vertical direction. Lower ends of the return communication channels 45 are connected to the respective communication openings 33*a*.

A first driver IC 47*a* and a second driver IC 47*b* are respectively arranged at a front end and a rear end of an upper surface of the actuator member 23. The driver ICs 47*a* and 47*b* are positioned such that its longitudinal direction corresponds to the sheet width direction. In this embodiment, the first driver IC 47*a* and the second driver IC 47*b* are positioned on the upper surface of the actuator member 23. This allows the first driver IC 47*a* and the second driver IC 47*b* to have the same position in the vertical direction.

The first driver IC 47*a* is connected to driving elements 43 included in the driving elements 43 and forming a front-side driving element group via traces or the like (not depicted). The first driver IC 47*a* drives the driving elements 43 forming the front-side driving element group. The second driver IC 47*b* is connected to driving elements 43 included in the driving elements 43 and forming a rear-side driving element group via traces or the like (not depicted). The second driver IC 47*b* drives the driving elements 43 forming the rear-side driving element group.

The second channel member 24, which is formed from a synthetic resin material or the like, is a plate-like member. A thickness H1 of the second channel member 24 is approximately 400 to 600 μm. The second channel member 24 is disposed on the upper surface of the actuator member 23. As depicted in FIGS. 2, 6, 8 to 10, the second channel member 24 includes four second supply channels 51, four second return channels 52, four first bypass channels 53, fourteen element accommodating portions 54, and two IC accommodating portions 55. The second supply channels 51, the second return channels 52, the first bypass channels 53, the element accommodating portions 54, and the IC accommodating portions 55 are formed by recesses that are opened in a lower surface of the second channel member 24.

Figure 6:
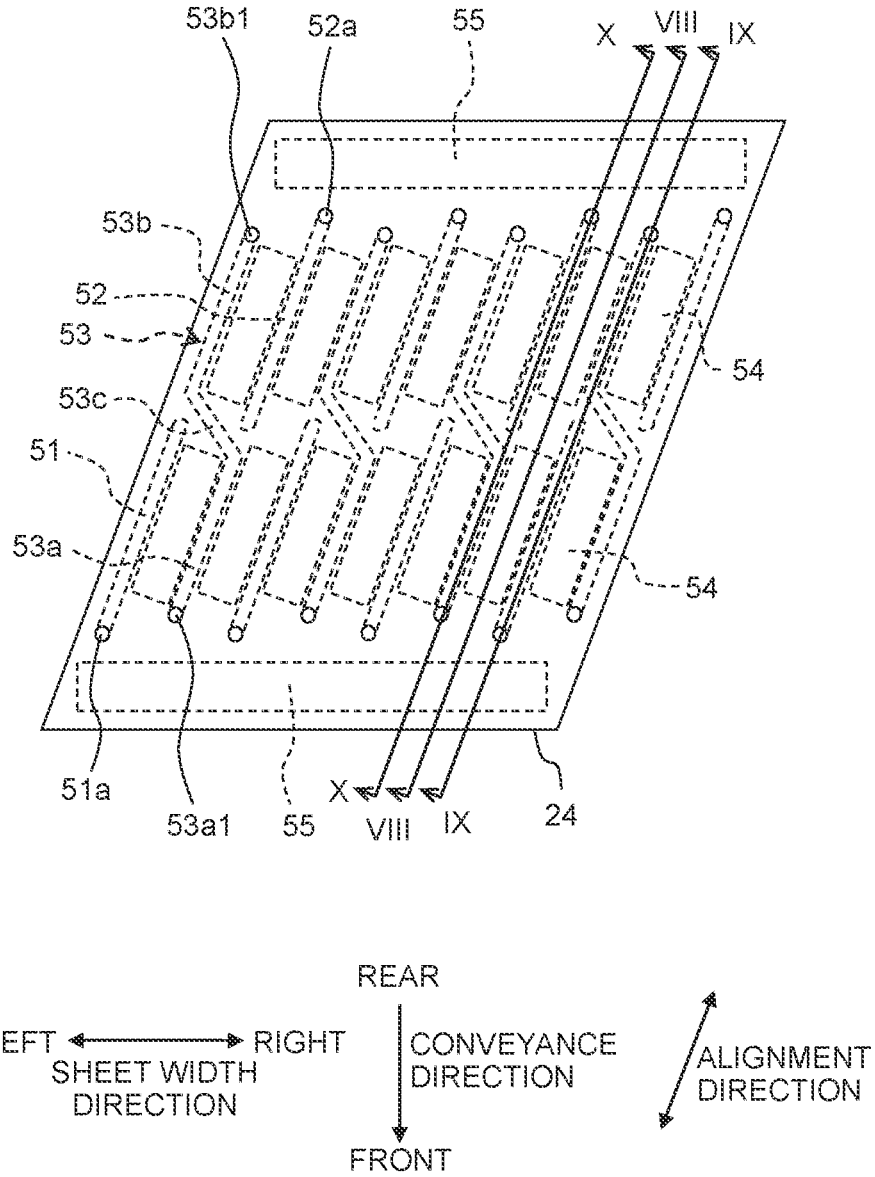
FIG. 6 is a plan view of a second channel member.

As depicted in FIG. 6, the four second supply channels 51 correspond to the four first supply channels 32. Each second supply channel 51 extends in the alignment direction over approximately a front half portion of the corresponding first supply channel 32. An end at the right-rear side of each second supply channel 51 is connected to the corresponding supply communication channel 44. An end at the left-front side of each second supply channel 51 extending in the alignment direction is formed having a communication opening 51*a* that is opened in an upper surface of the second channel member 24.

The four second return channels 52 correspond to the four first return channels 33. Each second return channel 52 extends in the alignment direction over approximately a rear half portion of the corresponding first return channel 33. An end at the left-front side of each second return channel 52 is connected to the corresponding return communication channel 45. An end at the right-rear side of each second return channel 52 extending in the alignment direction is formed having a communication opening 52*a* that is opened in the upper surface of the second channel member 24.

Each of the four first bypass channels 53 includes channel portions 53*a* to 53*c*.

The four channel portions 53*a* forming the four first bypass channels 53 extend in the alignment direction. The channel portions 53*a* and the second supply channels 51 are arranged alternately in the sheet width direction. Each channel portion 53*a* is positioned on an extension line of the second return channel 52 in the alignment direction. An end at the left-front side of the channel portion 53*a* extending in the alignment direction is formed having a communication opening 53*a*1 that is opened in the upper surface of the second channel member 24.

The four channel portions 53*b* forming the four first bypass channels 53 extend in the alignment direction. The channel portions 53*b* and the second return channels 52 are arranged alternately in the sheet width direction. Each channel portion 53*b* is positioned on an extension line of the second supply channel 51 in the alignment direction. An end at the right-rear side of the channel portion 53*b* extending in the alignment direction is formed having a communication opening 53*b*1 that is opened in the upper surface of the second channel member 24.

The four channel portions 53*c* forming the four first bypass channels 53 connect the ends at the right-rear side of the channel portions 53*a* and the ends at the left-front side of the channel portions 53*b*.

A height H2 (length in the vertical direction) of the second supply channels 51, the second return channels 52, and the first bypass channels 53 is approximately 200 to 300 μm, which is smaller than the thickness H1 of the second channel member 24.

The fourteen element accommodating portions 54 correspond to the seven nozzle rows 9. Two element accommodating portions 54 included in the fourteen element accommodating portions 54 correspond to one nozzle row 9 included in the seven nozzle rows 9. The two element accommodating portions 54 corresponding to one nozzle row 9 overlap in the vertical direction with driving elements 43 that are included in the driving elements 43 corresponding to one nozzle row 9 and that form the front-side driving element group and driving elements 43 that are included in the driving elements 43 corresponding to one nozzle row 9 and that form the rear-side driving element group. Thus, half of the driving elements 43 corresponding to one nozzle row 9 are accommodated in the corresponding one of the elements accommodating portions 54.

The two IC accommodating portions 55 overlap in the vertical direction with the driver ICs 47*a* and 47*b*. The first driver IC 47*a* is accommodated in the IC accommodating portion 55 at the front side. The second driver IC 47*b* is accommodated in the IC accommodating portion 55 at the rear side. Each of the IC accommodating portions 55 includes a thermal conductive member 56. The thermal conductive members 56 are interposed between the driver ICs 47*a*, 47*b* and the second channel member 24. The thermal conductive members 56 are formed from, for example, epoxy-based adhesive.

The third channel member 25, which is formed from, for example, alumina, is a rectangular parallelepiped member. As depicted in FIGS. 2 and 8 to 10, the third channel member 25 is disposed on the upper surface of the second channel member 24. A thickness H3 of the third channel member 25 is approximately 1,000 to 10,000 μm, which is larger than the thickness H1 of the second channel member 24.

As depicted in FIGS. 2 and 7 to 10, the third channel member 25 includes a third supply channel 61, a third return channel 62, and second bypass channels 63, 64. The third supply channel 61, the third return channel 62, and the second bypass channels 63, 64 are formed by recesses formed in a lower surface of the third channel member 25. This allows the third supply channel 61, the third return channel 62, and the second bypass channels 63, 64 to have the same position in the vertical direction.

Figure 7:
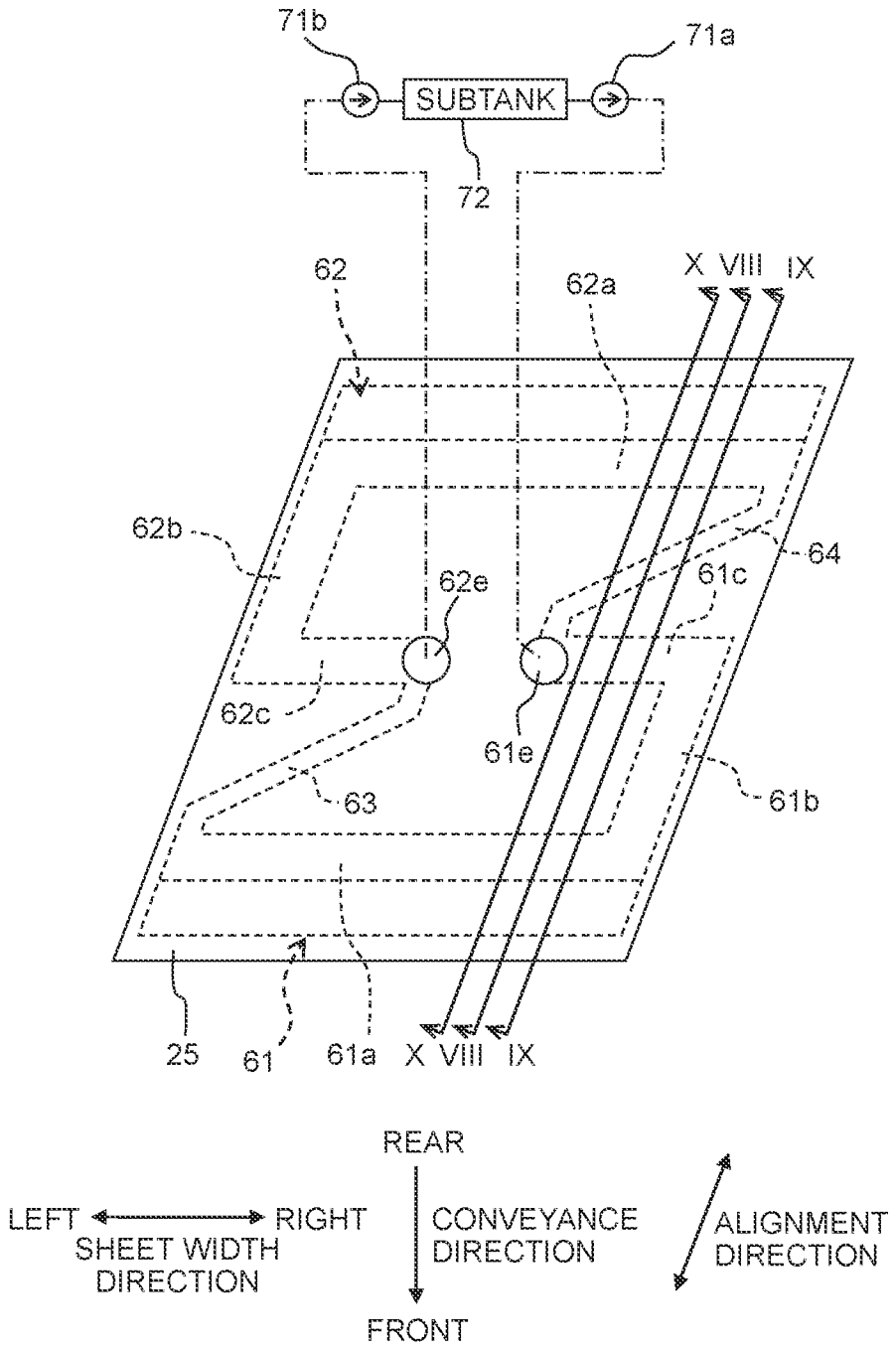
FIG. 7 is a plan view of a third channel member.

As depicted in FIG. 7, the third supply channel 61 has channel portions 61*a* to 61*c*. In a front portion of the third channel member 25, the channel portion 61*a* extends in the sheet width direction over the four communication openings 51*a* and the four communication openings 53*a*1. The channel portion 61*a* is connected to the communication openings 51*a* and 53*a*1. Further, a lower portion of the channel portion 61*a* extends frontward beyond an upper portion of the channel portion 61*a*. The lower portion of the channel portion 61*a* overlaps in the vertical direction with the first driver IC 47*a*. An inner wall surface 61*d* at the front side of the channel portion 61*a* is inclined to the vertical direction so that an upper portion thereof is positioned at the rear side of a lower portion thereof.

The channel portion 61*b* is connected to a right end of the channel portion 61*a*. The channel portion 61*b* extends in the alignment direction from the connection portion with the channel portion 61*a* to a center portion in the conveyance direction of the third channel member 25. The channel portion 61*c* is connected to a rear end of the channel portion 61*b*. The channel portion 61*c* extends leftward from the connection portion with the channel portion 61*b*. A left end of the channel portion 61*c* is formed having a supply opening 61*e* that is opened in an upper surface of the third channel member 25. In this embodiment, the left end of the channel portion 61*c* that is provided with the supply opening 61*e* corresponds to a "first end of the third supply channel" of the present disclosure.

The third return channel 62 has channel portions 62*a* to 62*c*. In a rear portion of the third channel member 25, the channel portion 62*a* extends in the sheet width direction over the four communication openings 52*a* and the four communication openings 53*b*1. The channel portion 62*a* is connected to the communication openings 52*a* and 53*b*1. A lower portion of the channel portion 62*a* extends rearward beyond an upper portion of the channel portion 62*a*. The lower portion of the channel portion 62*a* overlaps in the vertical direction with the second driver IC 47*b*. Further, an inner wall surface 62*d* at the rear side of the channel portion 62*a* is inclined to the vertical direction so that an upper portion thereof is positioned at the front side of a lower portion thereof.

The channel portion 62*b* is connected to a left end of the channel portion 62*a*. The channel portion 62*b* extends in the alignment direction from the connection portion with the channel portion 62*a* to the center portion in the conveyance direction of the third channel member 25. The channel portion 62*c* is connected to a front end of the channel portion 62*b*. The channel portion 62*c* extend rightward from the connection portion with the channel portion 62*b*. A right end of the channel portion 62*c* is formed having a discharge opening 62*e* that is opened in the upper surface of the third channel member 25. In this embodiment, the right end of the channel portion 62*c* that is provided with the discharge opening 62*e* corresponds to a "first end of the third return channel" of the present disclosure.

The second bypass channel 63 connects a left end of the channel portion 61*a* (a "second end of the third supply channel" of the present disclosure) and the right end of the channel portion 62*c* (a part of the third return channel 62 that is provided with the discharge opening 62*e*). The second bypass channel 64 connects a right end of the channel portion 62*a* (a "second end of the third return channel" of the present disclosure) and the left end of the channel portion 61*c* (a part of the third supply channel 61 that is provided with the supply opening 61*e*).

A height H4 (length in the vertical direction) of the third supply channel 61, the third return channel 62, and the second bypass channels 63, 64 is approximately 500 to 5,000 μm, which is smaller than the thickness H3 of the third channel member 25. The height H4 is larger than the height H2 of the second supply channels 51, the second return channels 52, and the first bypass channels 53. This makes a channel resistance of the second bypass channels 63, 64 smaller than that of the first bypass channels 53.

In the ink-jet head 11, the supply opening 61*e* is connected to a subtank 72 via a pump 71*a*. The pump 71*a* feeds ink from the subtank 72 toward the supply opening 61*e*. The subtank 72 is connected to a main tank (not depicted), such as an ink cartridge, via a tube (not depicted) and ink is supplied from the main tank. The discharge opening 62*e* is connected to the subtank 72 via a pump 71*b*. The pump 71*b* feeds ink from the discharge opening 62*e* toward the subtank 72.

Driving the pumps 71*a* and 71*b* causes ink in the subtank 72 to flow into the third supply channel 61 from the supply opening 61*e*. Part of ink in the third supply channel 61 flows into the second supply channels 51 from the communication openings 51*a*. A residual ink in the third supply channel 61 flows into the first bypass channels 53 from the communication openings 53*a*1 or into the second bypass channels 63, 64.

Ink in the second supply channels 51 flows into the supply communication channels 44, and then flows into the first supply channels 32 from the communication openings 32*a*. Part of ink in the first supply channels 32 flows into the respective individual channels 40. Ink in the individual channels 40 flows into the first return channels 33 adjacent to the first supply channels 32 in the sheet width direction. A residual ink in the first supply channels 32 flows, via the bypass channels 34, into the first return channels 33 adjacent to the first supply channels 32 in the sheet width direction.

Ink in the first return channels 33 flows into the return communication channels 45 from the communication openings 33*a*, and then flows into the second return channels 52. Ink in the second return channels 52 flows from the communication openings 52*a* into the third return channel 62. Further, ink in the first bypass channels 53 flows from the communication openings 53*b*1 into the third return channel 62. Furthermore, ink in the second bypass channels 63 and 64 flows into the third return channel 62. Ink in the third return channel 62 is discharged from the discharge opening 62*e* and returns to the subtank 72.

In this embodiment, ink flows as described above by driving the pumps 71*a* and 71*b*, and thus ink circulates between the ink-jet head 11 and the subtank 72. Only one of the pumps 71*a* and 71*b* may be provided. Also in this case, ink can circulate between the ink-jet head 11 and the subtank 72 similarly to the above configuration by driving one of the pumps.

<Effects of Embodiment>

Figure 9:
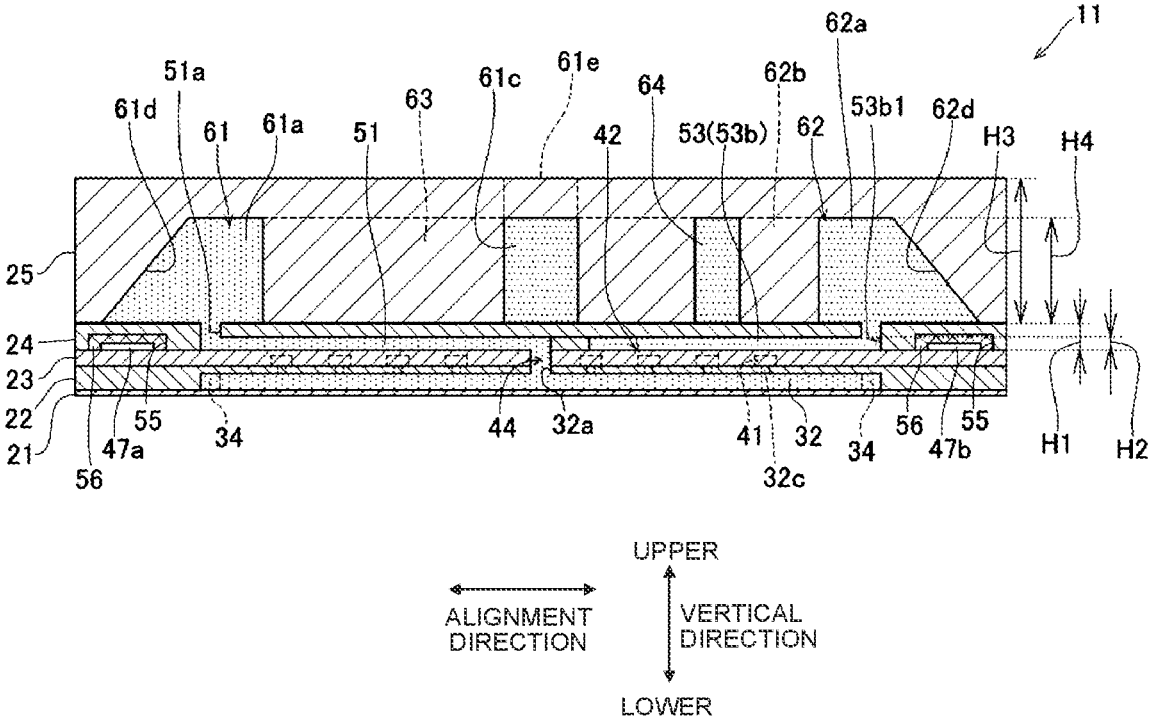
FIG. 9 is a cross-sectional view of the ink-jet head taken along a line IX-IX in FIGS. 3 to 7.
Figure 10:
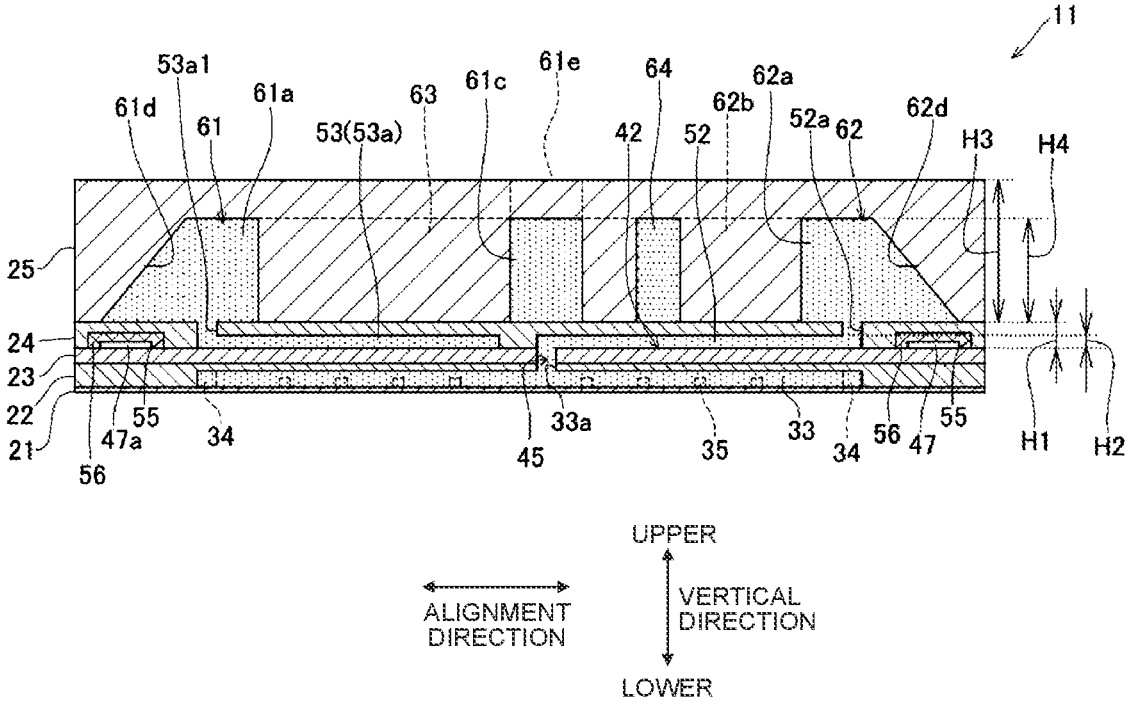
FIG. 10 is a cross-sectional view of the ink-jet head taken along a line X-X in FIGS. 3 to 7.

In this embodiment, heat is generated in the driving elements 43 and the driver ICs 47*a* and 47*b* at the time of driving the driving elements 43. Thus, in this embodiment, the third supply channel 61 is connected to the third return channel 62 via the first bypass channels 53 formed in the second channel member 24 as depicted in FIGS. 9 and 10. Further, the third supply channel 61 is connected to the third return channel 62 via the second bypass channels 63 and 64 formed in the third channel member 25 as depicted in FIG. 7.

This makes a flow rate (flow amount) of ink flowing from the third supply channel 61 to the third return channel 62 via the first bypass channels 53 and the second bypass channels 63, 64 sufficiently large. As a result, ink flowing from the third supply channel 61 to the third return channel 62 via the first bypass channels 53 and the second bypass channels 63, 64 allows heat generated in the driving elements 43 and the driver ICs 47*a*, 47*b* to be transmitted uniformly or evenly to respective parts of the ink-jet head 11, making it possible to make a temperature of the ink-jet head 11 uniform.

In this embodiment, the channel resistance of the second bypass channels 63 and 64 is smaller than that of the first bypass channels 53. Thus, in this embodiment, it is possible to make the flow rate (flow amount) of ink flowing from the third supply channel 61 to the third return channel 62 sufficiently larger than a case where the second bypass channels 63, 64 are not provided.

In this embodiment, the thickness H1 of the second channel member 24 is not so large. This makes the height H2 of the first bypass channels 53 small and makes the channel resistance of the first bypass channels 53 relatively large. Thus, in this embodiment, the thickness H3 of the third channel member 25 is larger than the thickness H1 of the second channel member 24. This makes the height H4 of the second bypass channels 63 and 64 larger than the height H2 of the first bypass channels 53, and makes the channel resistance of the second bypass channels 63 and 64 smaller than the channel resistance of the first bypass channels 53.

In this embodiment, the supply opening 61*e* is provided at a first end of the third supply channel 61 (left end of the channel portion 61*c*). In this case, air bubbles or the like are likely to accumulate at a second end of the third supply channel 61 (left end of the channel portion 61*a*). Thus, in this embodiment, the second bypass channel 63 is connected to the second end of the third supply channel 61. Air bubbles or the like are thus not likely to accumulate at the second end of the third supply channel 61.

In this embodiment, the second bypass channel 63 is connected to the part of the third return channel 62 that is provided with the discharge opening 62*e* (right end of the channel portion 62*c*). Thus, air bubbles or the like flowing from the third supply channel 61 to the third return channel 62 via the second bypass channel 63 can be discharged through the discharge opening 62*e* quickly.

In this embodiment, the discharge opening 62*e* is provided at a first end of the third return channel 62 (right end of the channel portion 62*c*). Air bubbles or the like are thus likely to accumulate at a second end of the third return channel 62 (right end of the channel portion 62*a*). Thus, in this embodiment, the second bypass channel 64 is connected to the second end of the third return channel 62. In this configuration, flowing of ink from the third supply channel 61 to the second end of the third return channel 62 via the second bypass channel 64 allows air bubbles or the like at the second end of the third return channel 62 to easily flow toward the discharge opening 62, thereby inhibiting air bubbles or the like from accumulating at the second end of the third return channel 62.

In this embodiment, the second bypass channel 64 is connected to the part of the third supply channel 61 that is provided with the supply opening 61*e* (left end of the channel portion 61*c*). Thus, air bubbles or the like flowing into the third supply channel 61 through the supply opening 61*e* easily flow to the third return channel 62 via the second bypass channel 64, thereby inhibiting air bubbles or the like from flowing toward the individual channels 40.

In this embodiment, the ink-jet head 11 includes the driver ICs 47*a* and 47*b*. Heat is generated in the driver ICs 47*a* and 47*b* at the time of driving the driving elements 43. However, the flow rate (flow amount) of ink flowing from the third supply channel 61 to the third return channel 62 via the first bypass channels 53 and the second bypass channels 63, 64 is sufficiently large as described above, which makes the temperature of the ink-jet head 11 uniform.

In this embodiment, the driver ICs 47*a* and 47*b* overlap in the vertical direction with the third channel member 25. Thus, heat generated in the driver ICs 47*a* and 47*b* can be transmitted efficiently to ink in the third supply channel 61 and ink in the third return channel 62. Thus, ink flowing from the third supply channel 61 to the third return channel 62 via the first bypass channels 53 and the second bypass channels 63, 64 allows heat generated in the driver ICs 47*a* and 47*b* to be transmitted uniformly to the ink-jet head 11.

In this embodiment, the first driver IC 47*a* overlaps in the vertical direction with the third supply channel 61, and the second driver IC 47*b* overlaps in the vertical direction with the third return channel 62. Thus, the first driver IC 47*a* and the second driver IC 47*b* have the same position in the vertical direction. The third supply channel 61 and the third return channel 62 have the same position in the vertical direction. Thus, the degree of transmission of the heat generated in the first driver IC 47*a* to the ink in the third supply channel 61 is equal to the degree of transmission of the heat generated in the second driver IC 47*b* to the ink in the third return channel 62. As a result, ink flowing from the third supply channel 61 to the third return channel 62 via the first bypass channels 53 and the second bypass channels 63, 64 allows heat generated in the driver ICs 47*a* and 47*b* to be transmitted uniformly to the ink-jet head 11.

Modified Embodiments

The embodiment of the present disclosure is explained above. The present disclosure, however, is not limited thereto. The present disclosure may be changed or modified without departing from the gist and the scope of the claims below.

The arrangement of the third supply channel, the third return channel, and the second bypass channels is not limited to the arrangement of the above embodiment.

For example, in the above embodiment, the first end of the third supply channel 61 (left end of the channel portion 61*c*) is provided with the supply opening 61*e*. The first end of the third return channel 62 (right end of the channel portion 62*c*) is provided with the discharge opening 62*e*. The second bypass channel 63 connects the second end of the third supply channel 61 (left end of the channel portion 61*a*) and the first end of the third return channel 62. The second bypass channel 64 connects the second end of the third return channel 62 (right end of the channel portion 62*a*) and the first end of the third supply channel 61. The aspects of the present disclosure, however, are not limited thereto.

The supply opening 61*e* may be provided in another part of the third supply channel 61. The second bypass channel 64 may be connected to the another part of the third supply channel 61 that is provided with the supply opening 61*e*. Alternatively, the second bypass channel 64 may be connected to a part of the third supply channel 61 that is different from the another part provided with the supply opening 61*e*.

In the configuration in which the discharge opening 62*e* is provided at the first end of the third return channel 62, the second bypass channel 64 may be connected to any other part of the third return channel 62 than the second end of the third return channel 62.

The discharge opening 62*e* may be provided at another part of the third return channel 62. The second bypass channel 63 may be connected to the another part of the third return channel 62 that is provided with the discharge opening 62*e*. Alternatively, the second bypass channel 63 may be connected to a part of the third return channel 62 that is different from the another part provided with the discharge opening 62*e*.

In the configuration in which the supply opening 61*e* is provided at the first end of the third supply channel 61, the second bypass channel 63 may be connected to any other part of the third supply channel 61 than the second end of the third supply channel 61.

One of the second bypass channel 63 and 64 may be not provided. Alternatively, in addition to the second bypass channels 63 and 64, any other second bypass channel may be provided to connect any part of the third supply channel 61 and any part of the third return channel 62.

The second bypass channels formed in the third channel member 25 may be connected to parts of the third supply channel 61 and the third return channel 62 that are different from the parts described above.

The arrangement of the third supply channel and the third return channel is not limited to the arrangement of the above embodiment.

First Modified Embodiment

Figure 11:
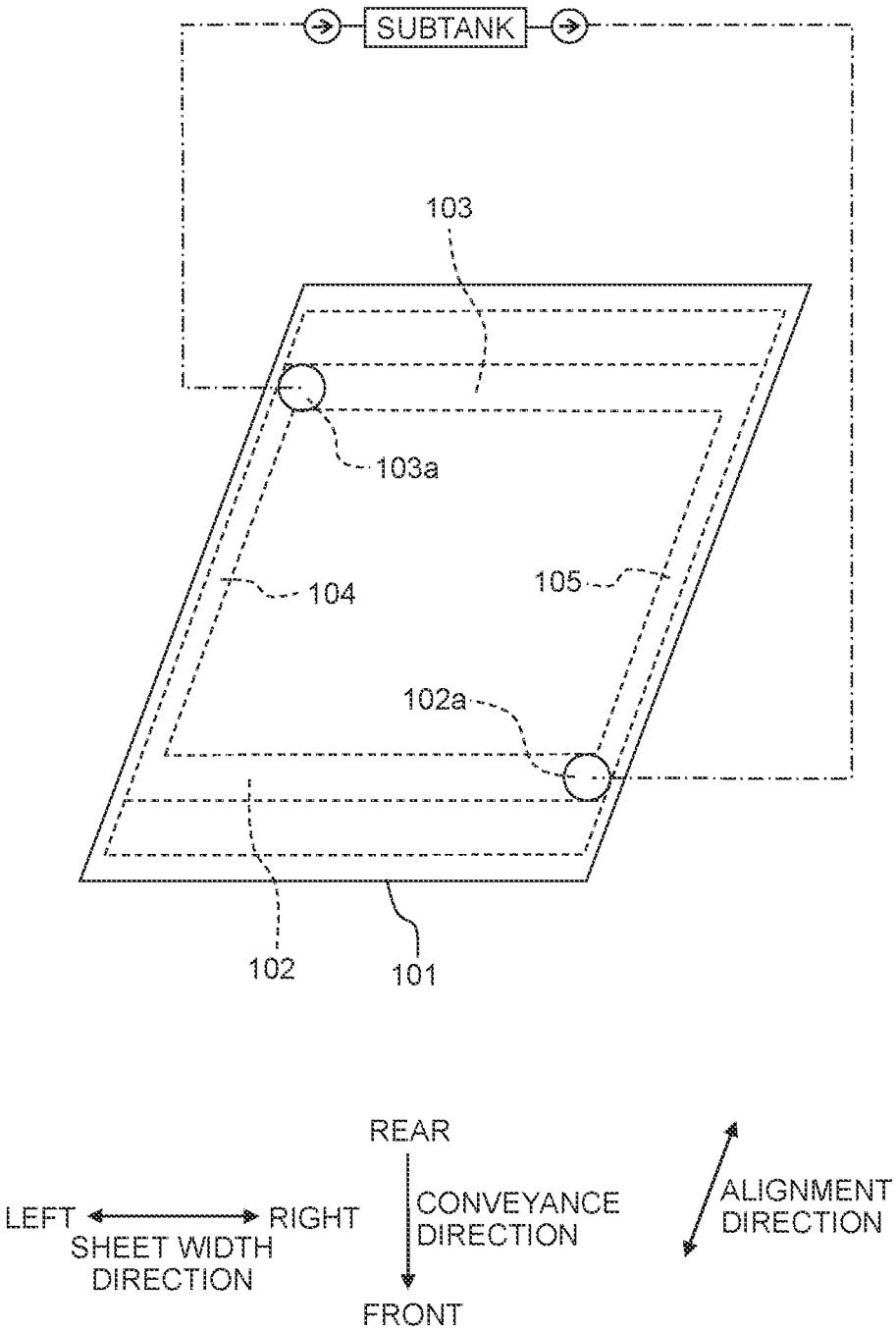
FIG. 11 is a plan view of a third channel member according to a first modified embodiment.

As depicted in FIG. 11, a third channel member 101 includes a third supply channel 102, a third return channel 103, and second bypass channels 104 and 105.

Similar to the channel portion 61*a* of the above embodiment, the third supply channel 102 extend in the sheet width direction. A supply opening 102*a*, which is opened in an upper surface of the third channel member 101, is provided at a right end of the third supply channel 102 ("an end at one side in the second direction" of the present disclosure).

Similar to the channel portion 62*a* of the above embodiment, the third return channel 103 extends in the sheet width direction. A discharge opening 103*a*, which is opened in the upper surface of the third channel member 101, is provided at a left end of the third return channel 103 ("an end at the other side in the second direction" of the present disclosure).

The second bypass channel 104 extends in the alignment direction to connect a left end of the third supply channel 102 and the left end of the third return channel 103. The second bypass channel 105 extends in the alignment direction to connect a right end of the third return channel 103 and the right end of the third supply channel 102.

In the first modified embodiment, the third supply channel 102 and the third return channel 103 extend in the sheet width direction. The supply opening 102*a* and the discharge opening 103*a* are provided at respective ends of the third supply channel 102 and the third return channel 103. The end of the third supply channel 102 with the supply opening 102*a* is at an opposite side in the sheet width direction of the end of the third return channel 103 with the discharge opening 103*a*. In this configuration, the individual channels 40, which communicate with the second supply channels 51 and the first supply channels 32 that correspond to the communication openings 51*a* farther from the supply opening 102*a*, communicate with the second return channels 52 and the first return channels 33 that correspond to the communication openings 52*a* closer to the discharge opening 103*a* (see FIGS. 4 to 6 related to the second supply channels 51, the first supply channels 32, the individual channels 40, the first return channels 33 and the second return channels 52).

It is thus possible to make the difference in the channel resistances as small as possible between ink channels through which ink flows from the supply opening 102*a* to the discharge opening 103*a* via the third supply channel 102, the second supply channels 51 and the first supply channels 32, the individual channels 40, the first return channels 33 and the second return channels 52, and the third return channel 103. As a result, it is possible to make the difference in the ink flow rates (ink flow amounts) during circulation between the individual channels 40 of the ink-jet head 11 as small as possible.

Second Modified Embodiment

Figure 12:
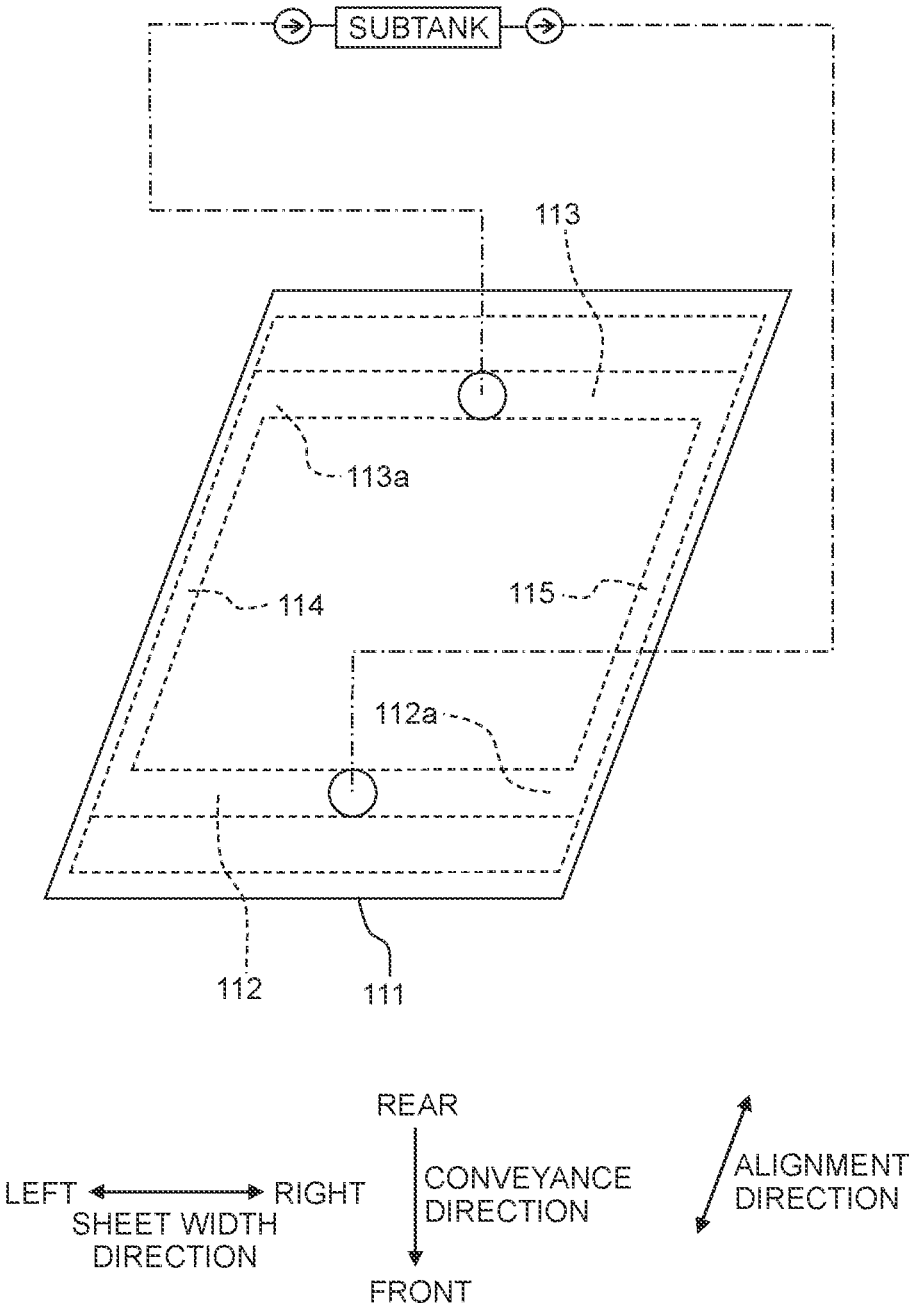
FIG. 12 is a plan view of a third channel member according to a second modified embodiment.

As depicted in FIG. 12, a third channel member 111 includes a third supply channel 112, a third return channel 113, and second bypass channels 114 and 115.

Similar to the third supply channel 102 of the first modified embodiment, the third supply channel 112 extends in the sheet width direction. A supply opening 112*a*, which is opened in an upper surface of the third channel member 111, is provided at a center portion in the sheet width direction of the third supply channel 112.

Similar to the third return channel 103 of the first modified embodiment, the third return channel 113 extends in the sheet width direction. A discharge opening 113*a*, which is opened in the upper surface of the third channel member 111, is provided at a center portion in the sheet width direction of the third return channel 113.

The second bypass channel 114 extends in the alignment direction to connect a left end of the third supply channel 112 and a left end of the third return channel 113. The second bypass channel 115 extends in the alignment direction to connect a right end of the third return channel 113 and a right end of the third supply channel 112.

In the second modified embodiment, the third supply channel 112 extends in the sheet width direction. The supply opening 112*a* is provided at the center portion in the sheet width direction of the third supply channel 112. This makes a difference in distances between the supply opening 112*a* of the third supply channel 112 and the communication openings 51*a* (see FIG. 6) of the respective second supply channels 51 smaller than a case where the supply opening 112*a* is provided at an end in the sheet width direction of the third supply channel 112.

In the second modified embodiment, the third return channel 113 extends in the sheet width direction. The discharge opening 113*a* is provided at the center portion in the sheet width direction of the third return channel 113. This makes a difference in distances between the discharge opening 113*a* of the third return channel 113 and the communication openings 52*a* (see FIG. 6) of the respective second return channels 52 smaller than a case where the discharge opening 113*a* is provided at an end in the sheet width direction of the third return channel 113.

Thus, in the second modified embodiment, it is possible to make the difference in the channel resistances as small as possible between the ink channels through which ink flows from the supply opening 112*a* to the discharge opening 113*a* via the third supply channel 112, the second supply channels 51 and the first supply channels 32, the individual channels 40, the first return channels 33 and the second return channels 52, and the third return channel 113 (see FIGS. 4 to 6 related to the second supply channels 51, the first supply channels 32, the individual channels 40, the first return channels 33 and the second return channels 52). As a result, it is possible to make the difference in the ink flow rates (ink flow amounts) during circulation between the individual channels 40 of the ink-jet head 11 as small as possible.

As described above, the difference in distances between the supply opening 112*a* of the third supply channel 112 and the communication openings 51*a* of the respective second supply channels 51 is small. Thus, the difference in channel resistances between the channels from the supply opening 112*a* to the individual channel(s) 40 disposed at the center portion in the sheet width direction and the channels from the supply opening 112*a* to the individual channel(s) 40 disposed at the end(s) in the sheet width direction is small. This inhibits variation in ink discharge between the nozzles 10.

Third Modified Embodiment

Figure 13:
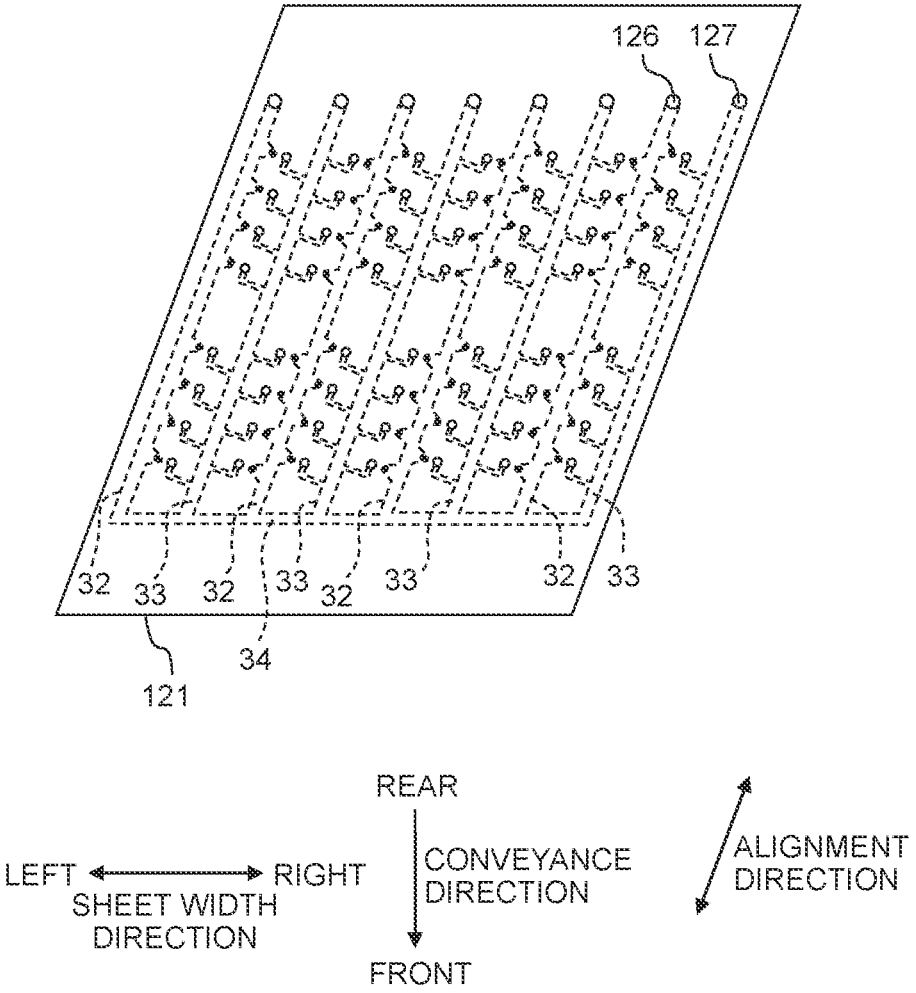
FIG. 13 is a plan view of a first channel member according to a third modified embodiment.

As depicted in FIG. 13, a communication opening 126 is provided at an end at the rear side (one side in the alignment direction) of each first supply channel 32 in a first channel member 121. A communication opening 127 is provided at an end at the rear side (one side in the alignment direction) of each first return channel 33 in the first channel member 121. In the third modified embodiment, similar to the above embodiment, the ends at the front side of the four first supply channels 32 are connected to the ends at the front side of the four first return channels 33 by the bypass channel 34. However, unlike the above embodiment, the ends at the rear side of the four first supply channels 32 are not connected to the ends at the rear end of the four first return channels 33.

Figure 14:
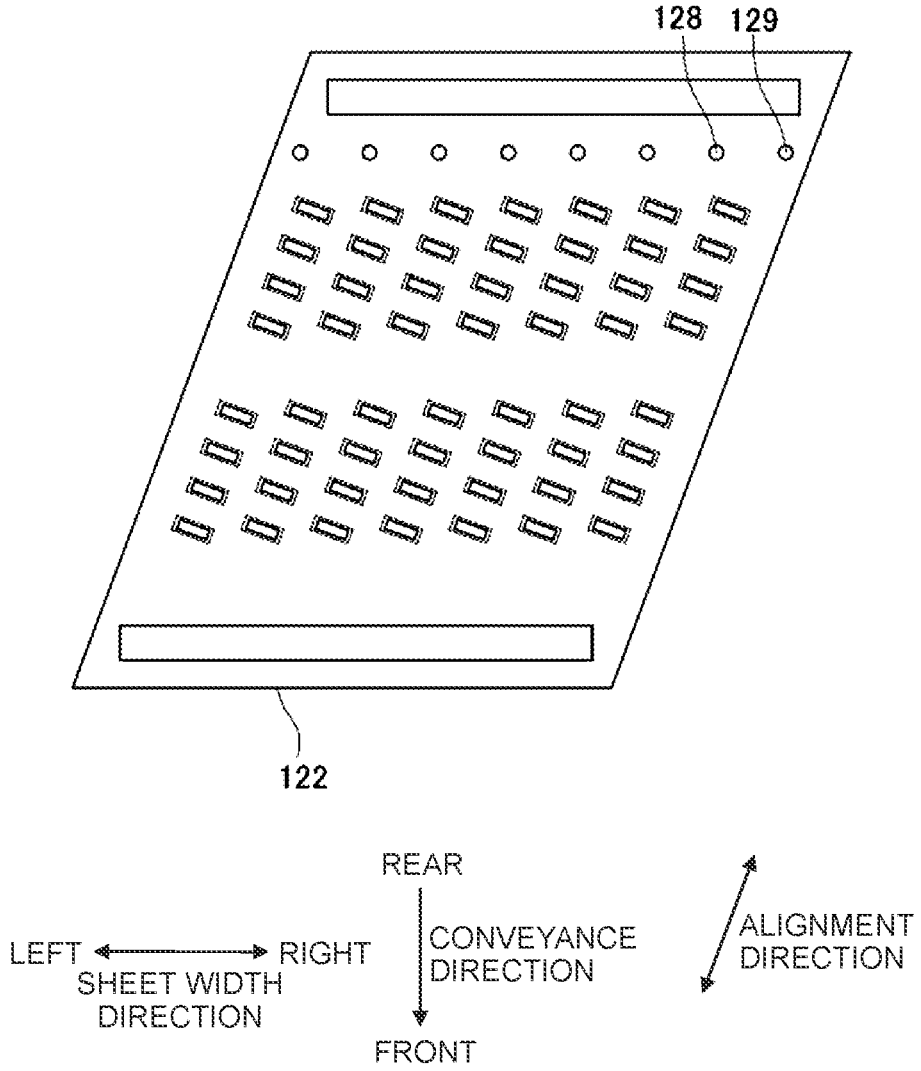
FIG. 14 is a plan view of an actuator member according to the third modified embodiment.

In the third modified embodiment, as depicted in FIG. 14, supply communication channels 128 are formed at parts of an actuator member 122 that overlap in the vertical direction with the communication openings 126. Return communication channels 129 are formed at parts of the actuator member 122 that overlap in the vertical direction with the communication openings 127.

Figure 15:
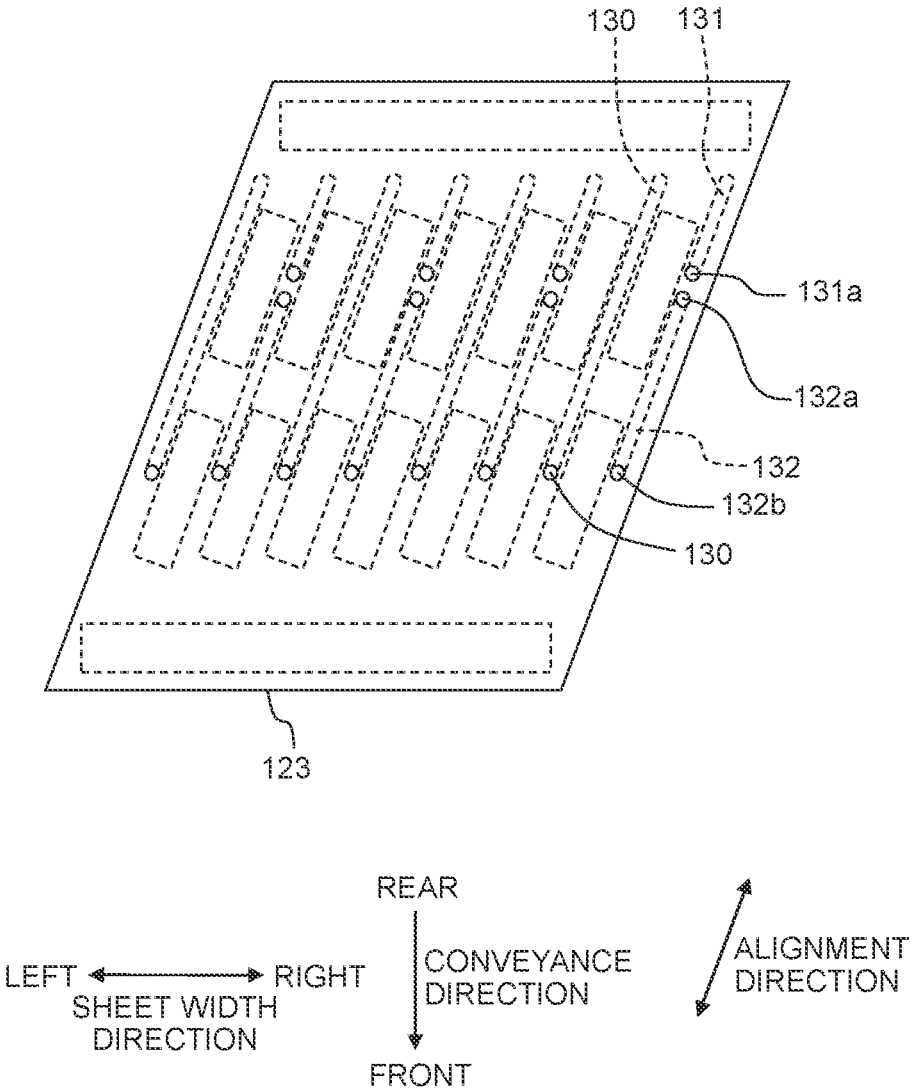
FIG. 15 is a plan view of a second channel member according to the third modified embodiment.

In the third modified embodiment, as depicted in FIG. 15, a second channel member 123 includes four second supply channels 130, four second return channels 131, and four first bypass channels 132.

The second supply channels 130 extend in the alignment direction. Ends at the rear side of the second supply channels 130 are connected to the supply communication channels 128. Ends at the front side of the second supply channels 130 are positioned at the front side of a center portion in the conveyance direction of the second channel member 123. A communication opening 130*a*, which is opened in an upper surface of the second channel member 123, is provided at the end at the front side of each second supply channel 130.

The second return channels 131 extend in the alignment direction. Ends at the rear side of the second return channels 131 are connected to the return communication channels 129. Ends at the front side of the second return channels 131 are positioned at the rear side of the center position in the conveyance direction of the second channel member 123. A communication opening 131*a*, which is opened in the upper surface of the second channel member 123, is provided at the end at the front side of each second return channel 131.

The four first bypass channels 132 are positioned at the front side of the four second return channels 131. The four first bypass channels 132 extend in the alignment direction. A communication opening 132*a*, which is opened in the upper surface of the second channel member 123, is provided at an end at the rear side of each first bypass channel 132. The communication openings 132*a* and the communication openings 131*a* are arranged adjacent to each other in the alignment direction.

The first bypass channels 132 extend in the conveyance direction to a position that is substantially the same as the ends at the front side of the second supply channels 130. A communication opening 132*b*, which is opened in the upper surface of the second channel member 123, is provided at an end at the front side of each first bypass channel 132. The communication openings 132*b* and the communication openings 130*a* are alternately arranged in the sheet width direction.

Figure 16:
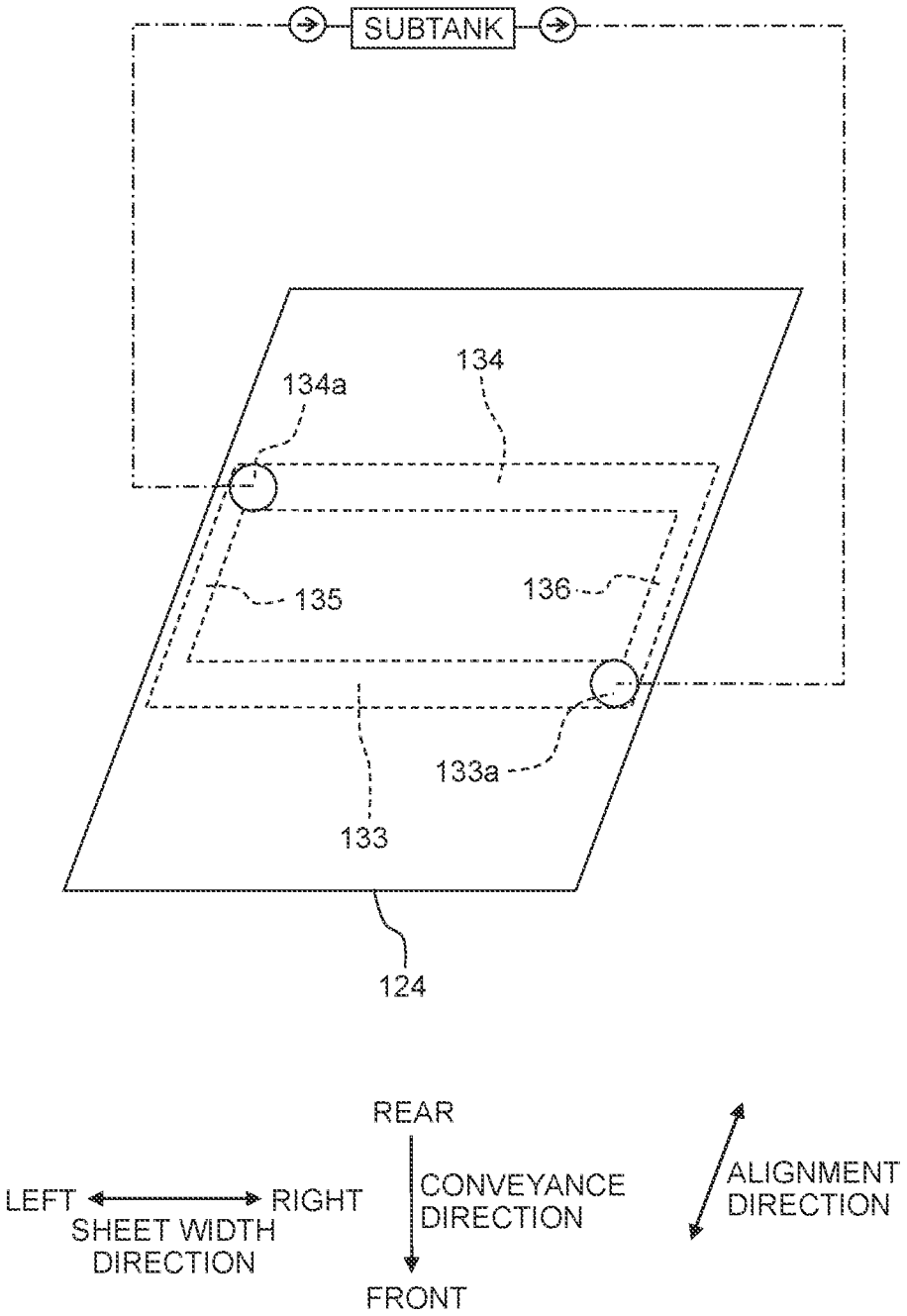
FIG. 16 is a plan view of a third channel member according to the third modified embodiment.

In the third modified embodiment, as depicted in FIG. 16, a third channel member 124 includes a third supply channel 133, a third return channel 134, second bypass channels 135, 136.

The third supply channel 133 extends in the sheet width direction over the four communication openings 130*a* and the four communication openings 132*a*. A right end of the third supply channel 133 is provided with a supply opening 133*a* that is opened in an upper surface of the third channel member 124.

The third return channel 134 extends in the sheet width direction over the four communication openings 131*a* and the four communication openings 132*b*. A left end of the third return channel 134 is provided with a discharge opening 134*a* that is opened in the upper surface of the third channel member 124.

The second bypass channel 135 extends in the alignment direction to connect a left end of the third supply channel 133 and the left end of the third return channel 134. The second bypass channel 136 extends in the alignment direction to connect the right end of the third supply channel 133 and a right end of the third return channel 134.

Accordingly, also in the third modified embodiment, the third supply channel 133 is connected to the third return channel 134 via the first bypass channels 132 and the second bypass channels 135, 136.

In the third modified embodiment, the four first supply channels 32 and the four first return channels 33 extend in the alignment direction and are arranged in the sheet width direction. The communication openings 126 and 127 are provided at the ends at the same side in the alignment direction of the first supply channels 32 and the first return channels 33. This allows the communication openings 126 and 127 to be positioned close to each other in the first channel member 121. It is thus possible to inhibit a positional shift between the communication openings 126 and the supply communication channels 128 and a positional shift between the communication openings 127 and the return communication channels 129 at the time of joining the first channel member 121 and the actuator member 122.

Fourth Modified Embodiment

Figure 17:
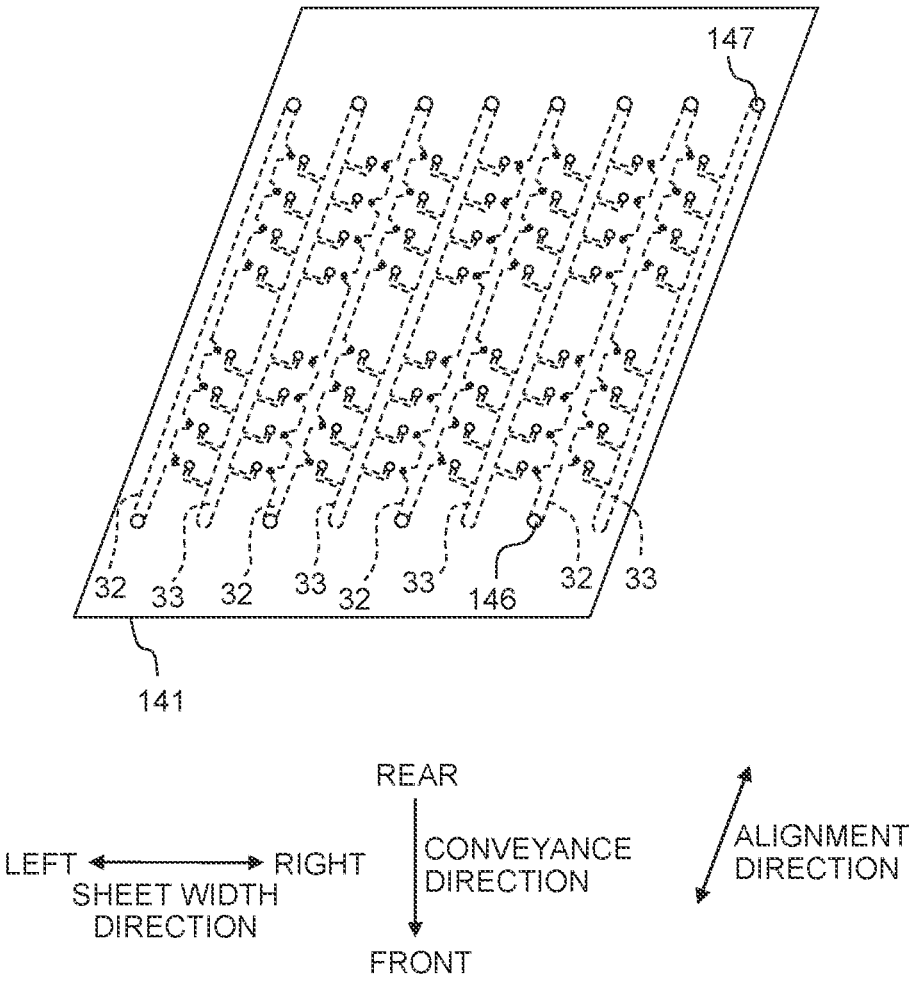
FIG. 17 is a plan view of a first channel member according to a fourth modified embodiment.

As depicted in FIG. 17, a communication opening 146 is provided at an end at the front side (one side in the alignment direction) of each first supply channel 32 in a first channel member 141. A communication opening 147 is provided at an end at the rear side (the other side in the alignment direction) of each first return channel 33 in the first channel member 141. In a fourth modified embodiment, unlike the above embodiment, the ends at the front side of the four first supply channels 32 are not connected to the ends at the front side of the four first return channels 33. The ends at the rear side of the four first supply channels 32 are not connected to the ends at the rear end of the four first return channels 33.

Figure 18:
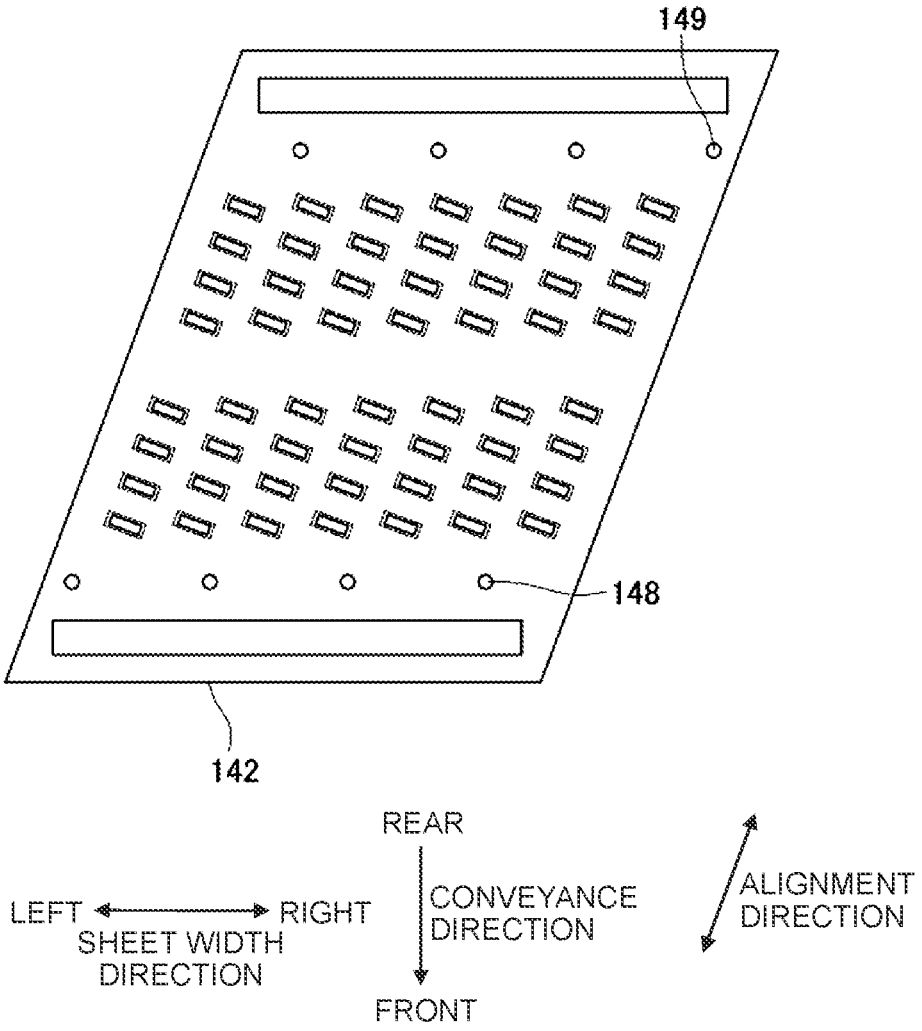
FIG. 18 is a plan view of an actuator member according to the fourth modified embodiment.

In the fourth modified embodiment, as depicted in FIG. 18, supply communication channels 148 are formed at parts of an actuator member 142 that overlap in the vertical direction with the communication openings 146. Return communication channels 149 are formed at parts of the actuator member 142 that overlap in the vertical direction with the communication openings 147.

Figure 19:
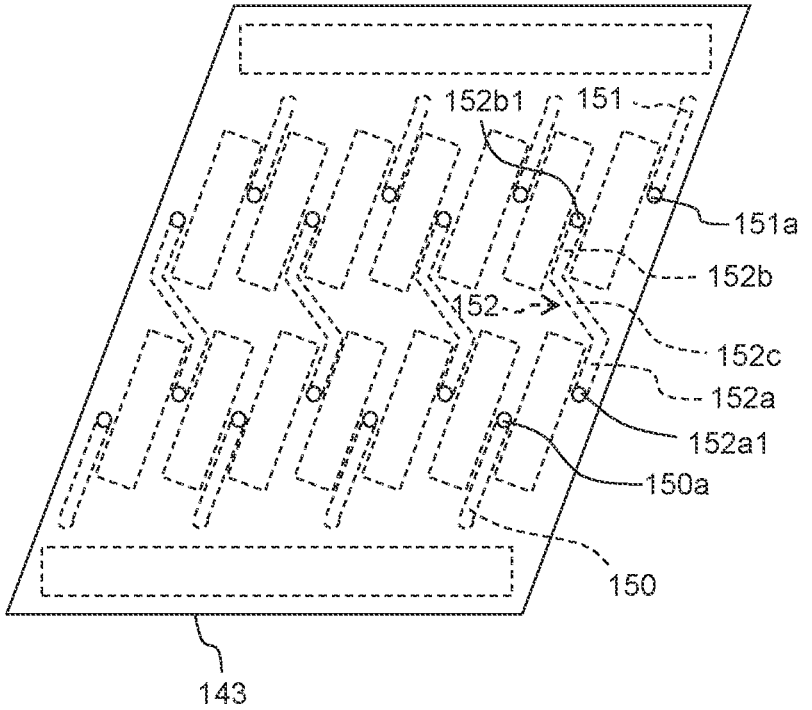
FIG. 19 is a plan view of a second channel member according to the fourth modified embodiment.
Figure 19:
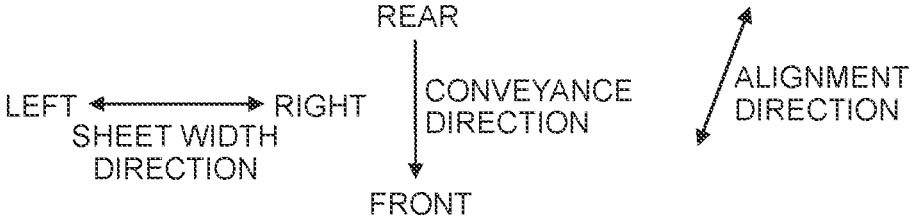

In the fourth modified embodiment, as depicted in FIG. 19, a second channel member 143 includes four second supply channels 150, four second return channels 151, and four first bypass channels 152.

The second supply channels 150 extend in the alignment direction. Ends at the front side of the second supply channels 150 are connected to the supply communication channels 148. Ends at the rear side of the second supply channels 150 are positioned at the front side of a center portion in the conveyance direction of the second channel member 143. A communication opening 150*a*, which is opened in an upper surface of the second channel member 143, is provided at the end at the rear side of each second supply channel 150.

The second return channels 151 extend in the alignment direction. Ends at the rear side of the second return channels 151 are connected to the return communication channels 149. Ends at the front side of the second return channels 151 are positioned at the rear side of the center portion in the conveyance direction of the second channel member 143. A communication opening 151*a*, which is opened in the upper surface of the second channel member 143, is provided at the end at the front side of each second return channel 151.

Each of the four first bypass channels 152 includes channel portions 152*a* to 152*c*. The four channel portions 152*a* forming the four first bypass channels 152 are positioned at the front side of the center portion in the conveyance direction of the second channel member 143 on extending lines of the second return channels 151 in the alignment direction. The four channel portions 152*a* extend in the alignment direction. A communication opening 152*a*1, which is opened in the upper surface of the second channel member 143, is provided at an end at the front side of each channel portion 152*a* extending in the alignment direction.

The four channel portions 152*b* forming the four first bypass channels 152 are positioned at the rear side of the center portion in the conveyance direction of the second channel member 143 on extending lines of the second supply channels 150 in the alignment direction. The four channel portions 152*b* extend in the alignment direction. A communication opening 152*b*1, which is opened in the upper surface of the second channel member 143, is provided at an end at the rear side of each channel portion 152*b* extending in the alignment direction.

The four channel portions 152*c* forming the four first bypass channels 152 connect ends at the rear side of the channel portions 152*a* and ends at the front side of the channel portions 152*b*.

In the fourth modified embodiment, the ink-jet head includes the third channel member 124 (see FIG. 16) similar to the third modified embodiment. In the fourth modified embodiment, the third supply channel 133 is connected to the four communication openings 150*a* and the four communication openings 152*a*1. The third return channel 134 is connected to the four communication openings 151*a* and the four communication openings 152*b*1.

Thus, also in the fourth modified embodiment, the third supply channel 133 is connected to the third return channel 134 via the first bypass channels 152 and the second bypass channels 135, 136.

In the fourth modified embodiment, the first supply channels 32 and the first return channels 33 extend in the alignment direction. Each of the communication openings 146 and each of the communication openings 147 are provided at the end of the corresponding one of the first supply channels 32 and the end of the corresponding one of the first return channels 33. The end of the first supply channel 32 with the communication opening 146 is at an opposite side in the alignment direction of the end of the first return channel 33 with the communication opening 147. Thus, a direction in which ink flows through the first supply channels 32 in the alignment direction during ink circulation between the ink-jet head and the subtank is the same as a direction in which ink flows through the first return channels 33 in the alignment direction during ink circulation between the ink-jet head and the subtank. In this configuration, when ink inflowing from the communication openings 146 and flowing through the first supply channels 32 passes through the individual channels 40, flows through the first return channels 33, and flows out of the communication openings 147, there is no need to reverse the direction in which ink flows in the alignment direction. It is thus possible to smoothly flow ink through the first supply channels 32 and the first return channels 33.

In the third and fourth modified embodiments, the supply opening 133*a* may be provided at another part of the third supply channel 133. The discharge opening 134*a* may be provided at another part of the third return channel 134. In the third and fourth modified embodiments, the second bypass channels may be connected to any other parts of the third supply channel 133 and the third return channel 134.

In the above embodiment, the driver ICs 47*a* and 47*b* are disposed below the third channel member 25. The third supply channel 61 overlaps in the vertical direction with the first driver IC 47*a*, and the third return channel 62 overlaps in the vertical direction with the second driver IC 47*b*. Further, the first driver IC 47*a* and the second driver IC 47*b* have the same position in the vertical direction, and the third supply channel 61 and the third return channel 62 have the same position in the vertical direction. The aspects of the present disclosure, however, are not limited thereto.

For example, the third supply channel 61 and the third return channel 62 may be formed in parts of the third channel member 25 that are different in positions in the vertical direction. Alternatively, at least one of the driver ICs 47*a* and 47*b* may be disposed in any other part of the actuator member of the ink-jet head 11 than the upper surface of the actuator member so that the first driver IC 47*a* and the second driver IC 47*b* have different positions in the vertical direction.

From among the combination of the third supply channel 61 and the first driver IC 47*a* and the combination of the third return channel 62 and the second driver IC 47*b*, at least one of them may not overlap with each other in the vertical direction. The number of driver ICs may be one or three or more.

The ink-jet head may not include the driver ICs. For example, a trace member may be connected to the upper surface of the actuator member, and the driver IC(s) may be mounted on part(s) of the trace member that is/are pulled out from the ink-jet head. Alternatively, the driver IC(s) may be mounted on a substrate or the like connected to the trace member.

Also in this case, heat is generated in the driving elements 43 at the time of driving the driving elements 43. Thus, it is significant that the temperature of the ink-jet head 11 is made to be uniform by sufficiently increasing the flow rate (flow amount) of ink flowing from the third supply channel 61 to the third return channel 62 via the first bypass channels 53 and the second bypass channels 63, 64, as described above.

In the above embodiment, the thickness H3 of the third channel member 25 is larger than the thickness H1 of the second channel member 24, thereby making it possible to make the height H4 of the second bypass channels 63 and 64 larger than the height H2 of the first bypass channels 53. Further, the channel resistance of the second bypass channels 63, 64 is made to be smaller than that of the first bypass channels 53 by making the height H4 of the second bypass channels 63, 64 larger than the height H2 of the first bypass channels 53. The aspects of the present disclosure, however, are not limited thereto.

For example, the channel resistance of the second bypass channels 63, 64 may be made to be smaller than that of the first bypass channels 53 by making the width of the second bypass channels 63, 64 larger than the width of the first bypass channels 53. In this case, the height of the third channel member 25 may be not more than the height of the second channel member 24.

The channel resistance of the second bypass channels 63, 64 may be not more than the channel resistance of the first bypass channels 53. Also in this case, the flow rate (flow amount) of ink flowing between the third supply channel and the third return channel is larger than a case where the second bypass channels 63, 64 are not provided, making it possible to uniformize the temperature of the ink-jet head.

The above explanation is made about the examples in which the present disclosure is applied to the ink-jet head of the line type. The aspects of the present disclosure, however, are not limited thereto. For example, the present disclosure can be applied to a so-called serial head that is carried on a carriage and in which ink is discharged from nozzles during its movement together with the carriage.

The above explanation is made about the examples in which the present disclosure is applied to the ink-jet head in which ink is discharged from nozzles. The aspects of the present disclosure, however, are not limited thereto. The present disclosure can be applied to a liquid discharge head that discharges any other liquid than ink.

What is claimed is:

1. A liquid discharge head, comprising:

a nozzle member including a plurality of nozzles that form parts of a plurality of individual channels, the nozzles forming a plurality of nozzle rows that extend in a first direction, the nozzle rows being arranged in a second direction intersecting with the first direction;

a plurality of driving elements corresponding to the respective individual channels, each of the driving elements configured to apply discharge energy to a liquid in a corresponding one of the individual channels;

a first channel member disposed at one side of the nozzle member in a third direction orthogonal to the first direction and the second direction, the first channel member including:

a plurality of first supply channels corresponding to the respective nozzle rows, the first supply channels extending in the first direction, each of the first supply channels communicating with a corresponding one of the individual channels; and a plurality of first return channels corresponding to the respective nozzle rows, the first return channels extending in the first direction, each of the first return channels communicating with a corresponding one of the individual channels;

a second channel member disposed at the one side of the first channel member in the third direction, the second channel member including:

a plurality of second supply channels corresponding to the respective first supply channels, each of the second supply channels communicating with a corresponding one of the first supply channels; and a plurality of second return channels corresponding to the respective first return channels, each of the second return channels communicating with a corresponding one of the first return channels;

a third channel member disposed at the one side of the second channel member in the third direction, the third channel member including:

a third supply channel provided in common to the second supply channels and communicating with the second supply channels; and a third return channel provided in common to the second return channels and communicating with the second return channels, wherein the second channel member further includes a first bypass channel connecting the third supply channel and the third return channel, and wherein the third channel member further includes a second bypass channel connecting the third supply channel and the third return channel.

2. The liquid discharge head according to claim 1, wherein a channel resistance of the second bypass channel is smaller than a channel resistance of the first bypass channel.

3. The liquid discharge head according to claim 2, wherein a length in the third direction of the third channel member is longer than a length in the third direction of the second channel member, and wherein a length in the third direction of the second bypass channel is longer than a length in the third direction of the first bypass channel.

4. The liquid discharge head according to claim 1, wherein the third supply channel includes a supply opening at a first end of the third supply channel, the liquid being supplied to the third supply channel through the supply opening, and wherein the second bypass channel is connected to a second end of the third supply channel.

5. The liquid discharge head according to claim 4, wherein the third return channel includes a discharge opening, the liquid being discharged from the third return channel through the discharge opening, and wherein the second bypass channel is connected to a part of the second return channel including the discharge opening.

6. The liquid discharge head according to claim 1, wherein the third return channel includes a discharge opening at a first end of the third return channel, the liquid being discharged from the third return channel through the discharge opening, and wherein the second bypass channel is connected to a second end of the third return channel.

7. The liquid discharge head according to claim 6, wherein the third supply channel includes a supply opening, the liquid being supplied to the third supply channel through the supply opening, and wherein the second bypass channel is connected to a part of the third supply channel including the supply opening.

8. The liquid discharge head according to claim 1, wherein the second supply channels and the second return channels are arranged in the second direction, wherein the third supply channel and the third return channel extend in the second direction, wherein the third supply channel includes a supply opening at an end at one side in the second direction of the third supply channel, the liquid being supplied to the third supply channel through the supply opening, and wherein the third return channel includes a discharge opening at an end at the other side in the second direction of the third return channel, the liquid being discharged from the third return channel through the discharge opening.

9. The liquid discharge head according to claim 1, wherein the second supply channels and the second return channels are arranged in the second direction, wherein the third supply channel and the third return channel extend in the second direction, wherein the third supply channel includes a supply opening at a center portion in the second direction of the third supply channel, the liquid being supplied to the third supply channel through the supply opening, and wherein the third return channel includes a discharge opening at a center portion in the second direction of the third return channel, the liquid being discharged from the third return channel through the discharge opening.

10. The liquid discharge head according to claim 1, further comprising a driver IC configured to drive the driving elements.

11. The liquid discharge head according to claim 10, wherein the driver IC is disposed at the other side in the third direction of the third channel member, and wherein the driver IC overlaps in the third direction with the third channel member.

12. The liquid discharge head according to claim 11, wherein the driver IC is one of a plurality of driver ICs that include a first driver IC overlapping in the third direction with the third supply channel and a second driver IC overlapping in the third direction with the third return channel, wherein the third supply channel and the third return channel have an identical position in the third direction, and wherein the first driver IC and the second driver IC have an identical position in the third direction.

13. The liquid discharge head according to claim 1, wherein ends at one side in the first direction of the first supply channels are connected to the second supply channels, and wherein ends at the one side in the first direction of the first return channels are connected to the second return channels.

14. The liquid discharge head according to claim 1, wherein ends at one side in the first direction of the first supply channels are connected to the second supply channels, and wherein ends at the other side in the first direction of the first return channels are connected to the second return channels.

* * * * *